US008524066B2

(12) United States Patent
Sivasankar et al.

(10) Patent No.: US 8,524,066 B2
(45) Date of Patent: Sep. 3, 2013

(54) ELECTROCHEMICAL PRODUCTION OF UREA FROM NOX AND CARBON DIOXIDE

(75) Inventors: Narayanappa Sivasankar, Plainsboro, NJ (US); Emily Cole, Princeton, NJ (US); Kyle Teamey, Washington, DC (US); Andrew Bocarsly, Plainsboro, NJ (US)

(73) Assignee: Liquid Light, Inc., Monmouth Junction, NJ (US)

( * ) Notice: Subject to any disclaimer, the term of this patent is extended or adjusted under 35 U.S.C. 154(b) by 319 days.

(21) Appl. No.: 12/875,227

(22) Filed: Sep. 3, 2010

(65) Prior Publication Data

US 2011/0114503 A1 May 19, 2011

Related U.S. Application Data

(63) Continuation-in-part of application No. 12/846,221, filed on Jul. 29, 2010, and a continuation-in-part of application No. 12/845,995, filed on Jul. 29, 2010, and a continuation-in-part of application No. 12/846,011, filed on Jul. 29, 2010, and a continuation-in-part of application No. 12/846,002, filed on Jul. 29, 2010.

(51) Int. Cl.
*C25B 3/00* (2006.01)

(52) U.S. Cl.
USPC ..... 205/436; 205/431

(58) Field of Classification Search
USPC ..... 205/431, 436, 555
See application file for complete search history.

(56) References Cited

U.S. PATENT DOCUMENTS

| | | | |
|---|---|---|---|
| 3,399,966 | A | 9/1968 | Suzuki et al. |
| 3,401,100 | A | 9/1968 | Macklin |
| 3,560,354 | A | 2/1971 | Young |
| 3,636,159 | A | 1/1972 | Solomon |
| 3,720,591 | A | 3/1973 | Skarlos |
| 3,779,875 | A | 12/1973 | Michelet |
| 3,899,401 | A | 8/1975 | Nohe et al. |
| 3,959,094 | A | 5/1976 | Steinberg |

(Continued)

FOREIGN PATENT DOCUMENTS

| | | | |
|---|---|---|---|
| AU | 2012202601 | A1 | 5/2012 |
| CA | 2604569 | A1 | 10/2006 |

(Continued)

OTHER PUBLICATIONS

Shibata et al., "Simultaneous Reduction of Carbon Dioxide and Nitrate Ions at Gas-Diffusion Electrodes with Various Metal-lophthalocyanine Catalysts", Electrochimica Acta (no month, 2003), vol. 48, pp. 3953-3958.*

(Continued)

*Primary Examiner* — Edna Wong
(74) *Attorney, Agent, or Firm* — Suiter Swantz pc llo

(57) ABSTRACT

Methods and systems for electrochemical production of urea are disclosed. A method may include, but is not limited to, steps (A) to (B). Step (A) may introduce carbon dioxide and NOx to a solution of an electrolyte and a heterocyclic catalyst in an electrochemical cell. The divided electrochemical cell may include an anode in a first cell compartment and a cathode in a second cell compartment. The cathode may reduce the carbon dioxide and the NOx into a first sub-product and a second sub-product, respectively. Step (B) may combine the first sub-product and the second sub-product to produce urea.

15 Claims, 8 Drawing Sheets

(56) References Cited

U.S. PATENT DOCUMENTS

| | | | | |
|---|---|---|---|---|
| 4,072,583 | A | 2/1978 | Hallcher et al. | |
| 4,088,682 | A | 5/1978 | Jordan | |
| 4,160,816 | A | 7/1979 | Williams et al. | |
| 4,219,392 | A | 8/1980 | Halmann | |
| 4,381,978 | A | 5/1983 | Gratzel et al. | |
| 4,414,080 | A | 11/1983 | Williams et al. | |
| 4,439,302 | A | 3/1984 | Wrighton et al. | |
| 4,450,055 | A | 5/1984 | Stafford | |
| 4,451,342 | A | 5/1984 | Lichtin et al. | |
| 4,460,443 | A | 7/1984 | Somorjai et al. | |
| 4,474,652 | A | 10/1984 | Brown et al. | |
| 4,476,003 | A | 10/1984 | Frank et al. | |
| 4,478,694 | A | 10/1984 | Weinberg | |
| 4,478,699 | A | 10/1984 | Halmann et al. | |
| 4,595,465 | A | 6/1986 | Ang et al. | |
| 4,608,132 | A | 8/1986 | Sammells | |
| 4,608,133 | A | 8/1986 | Morduchowitz et al. | |
| 4,609,440 | A | 9/1986 | Frese, Jr. et al. | |
| 4,609,441 | A | 9/1986 | Frese, Jr. et al. | |
| 4,609,451 | A | 9/1986 | Sammells et al. | |
| 4,619,743 | A | 10/1986 | Cook | |
| 4,620,906 | A | 11/1986 | Ang | |
| 4,668,349 | A | 5/1987 | Cuellar et al. | |
| 4,673,473 | A | 6/1987 | Ang et al. | |
| 4,702,973 | A | 10/1987 | Marianowski | |
| 4,756,807 | A | 7/1988 | Meyer et al. | |
| 4,776,171 | A | 10/1988 | Perry, Jr. et al. | |
| 4,793,904 | A | 12/1988 | Mazanec et al. | |
| 4,824,532 | A | 4/1989 | Moingeon et al. | |
| 4,855,496 | A | 8/1989 | Anderson et al. | |
| 4,897,167 | A | 1/1990 | Cook et al. | |
| 4,902,828 | A | 2/1990 | Wickenhaeuser et al. | |
| 4,921,586 | A | 5/1990 | Molter | |
| 4,936,966 | A | 6/1990 | Garnier et al. | |
| 4,945,397 | A | 7/1990 | Schuetz | |
| 4,959,131 | A | 9/1990 | Cook et al. | |
| 5,064,733 | A | 11/1991 | Krist et al. | |
| 5,246,551 | A | 9/1993 | Pletcher et al. | |
| 5,284,563 | A | 2/1994 | Fujihira et al. | |
| 5,382,332 | A | 1/1995 | Fujihira et al. | |
| 5,443,804 | A | 8/1995 | Parker et al. | |
| 5,587,083 | A | 12/1996 | Twardowski | |
| 5,763,662 | A | 6/1998 | Ikariya et al. | |
| 5,804,045 | A * | 9/1998 | Orillon et al. | 204/280 |
| 5,858,240 | A | 1/1999 | Twardowski et al. | |
| 5,928,806 | A | 7/1999 | Olah et al. | |
| 6,024,935 | A | 2/2000 | Mills et al. | |
| 6,187,465 | B1 | 2/2001 | Galloway | |
| 6,251,256 | B1 | 6/2001 | Blay et al. | |
| 6,270,649 | B1 | 8/2001 | Zeikus et al. | |
| 6,409,893 | B1 | 6/2002 | Holzbock et al. | |
| 6,657,119 | B2 | 12/2003 | Lindquist et al. | |
| 6,755,947 | B2 | 6/2004 | Schulze et al. | |
| 6,777,571 | B2 | 8/2004 | Chaturvedi et al. | |
| 6,806,296 | B2 | 10/2004 | Shiroto et al. | |
| 6,887,728 | B2 | 5/2005 | Miller et al. | |
| 6,906,222 | B2 | 6/2005 | Slany et al. | |
| 6,936,143 | B1 | 8/2005 | Graetzel et al. | |
| 6,942,767 | B1 | 9/2005 | Fazzina et al. | |
| 7,037,414 | B2 | 5/2006 | Fan | |
| 7,052,587 | B2 | 5/2006 | Gibson et al. | |
| 7,094,329 | B2 | 8/2006 | Saha et al. | |
| 7,314,544 | B2 | 1/2008 | Murphy et al. | |
| 7,318,885 | B2 | 1/2008 | Omasa | |
| 7,338,590 | B1 | 3/2008 | Shelnutt et al. | |
| 7,361,256 | B2 | 4/2008 | Henry et al. | |
| 7,378,561 | B2 | 5/2008 | Olah et al. | |
| 7,704,369 | B2 | 4/2010 | Olah et al. | |
| 7,883,610 | B2 | 2/2011 | Monzyk et al. | |
| 8,313,634 | B2 | 11/2012 | Bocarsly et al. | |
| 2001/0026884 | A1 | 10/2001 | Appleby et al. | |
| 2003/0029733 | A1 | 2/2003 | Otsuka et al. | |
| 2004/0089540 | A1 | 5/2004 | Van Heuveln et al. | |
| 2005/0011755 | A1 | 1/2005 | Jovic et al. | |
| 2005/0011765 | A1 | 1/2005 | Omasa | |
| 2005/0051439 | A1 | 3/2005 | Jang | |
| 2006/0102468 | A1 | 5/2006 | Monzyk et al. | |
| 2006/0235091 | A1 | 10/2006 | Olah et al. | |
| 2006/0243587 | A1 | 11/2006 | Tulloch et al. | |
| 2007/0045125 | A1 | 3/2007 | Hartvigsen et al. | |
| 2007/0054170 | A1 | 3/2007 | Isenberg | |
| 2007/0122705 | A1 | 5/2007 | Paulsen et al. | |
| 2007/0184309 | A1 | 8/2007 | Gust, Jr. et al. | |
| 2007/0224479 | A1 | 9/2007 | Tadokoro et al. | |
| 2007/0231619 | A1 | 10/2007 | Strobel et al. | |
| 2007/0240978 | A1 | 10/2007 | Beckmann et al. | |
| 2007/0254969 | A1 | 11/2007 | Olah et al. | |
| 2007/0282021 | A1 | 12/2007 | Campbell | |
| 2008/0011604 | A1 | 1/2008 | Stevens et al. | |
| 2008/0039538 | A1 | 2/2008 | Olah et al. | |
| 2008/0060947 | A1 | 3/2008 | Kitsuka et al. | |
| 2008/0072496 | A1 | 3/2008 | Yogev et al. | |
| 2008/0090132 | A1 | 4/2008 | Ivanov et al. | |
| 2008/0116080 | A1 | 5/2008 | Lal et al. | |
| 2008/0145721 | A1 | 6/2008 | Shapiro et al. | |
| 2008/0223727 | A1 | 9/2008 | Oloman et al. | |
| 2008/0283411 | A1 | 11/2008 | Eastman et al. | |
| 2008/0287555 | A1 | 11/2008 | Hussain et al. | |
| 2008/0296146 | A1 | 12/2008 | Toulhoat et al. | |
| 2009/0014336 | A1 | 1/2009 | Olah et al. | |
| 2009/0030240 | A1 | 1/2009 | Olah et al. | |
| 2009/0038955 | A1 | 2/2009 | Rau | |
| 2009/0061267 | A1 | 3/2009 | Monzyk et al. | |
| 2009/0069452 | A1 | 3/2009 | Robota | |
| 2009/0134007 | A1 | 5/2009 | Solis Herrera | |
| 2009/0277799 | A1 | 11/2009 | Grimes | |
| 2010/0084280 | A1 | 4/2010 | Gilliam et al. | |
| 2010/0147699 | A1 | 6/2010 | Wachsman et al. | |
| 2010/0150802 | A1 | 6/2010 | Gilliam et al. | |
| 2010/0180889 | A1 | 7/2010 | Monzyk et al. | |
| 2010/0187123 | A1 | 7/2010 | Bocarsly et al. | |
| 2010/0191010 | A1 | 7/2010 | Bosman et al. | |
| 2010/0193370 | A1 | 8/2010 | Olah et al. | |
| 2010/0196800 | A1 | 8/2010 | Markoski et al. | |
| 2010/0213046 | A1 | 8/2010 | Grimes et al. | |
| 2010/0248042 | A1 | 9/2010 | Nakagawa et al. | |
| 2010/0307912 | A1 | 12/2010 | Zommer | |
| 2011/0014100 | A1 | 1/2011 | Bara et al. | |
| 2011/0114501 | A1 | 5/2011 | Teamey et al. | |
| 2011/0114502 | A1 | 5/2011 | Cole et al. | |
| 2011/0114503 | A1 | 5/2011 | Sivasankar et al. | |
| 2011/0114504 | A1* | 5/2011 | Sivasankar et al. | 205/455 |
| 2011/0143929 | A1 | 6/2011 | Sato et al. | |
| 2011/0186441 | A1 | 8/2011 | LaFrancois et al. | |
| 2011/0226632 | A1 | 9/2011 | Cole et al. | |

FOREIGN PATENT DOCUMENTS

| | | | |
|---|---|---|---|
| DE | 1047765 | A | 12/1958 |
| DE | 2301032 | A | 7/1974 |
| EP | 0111870 | B1 | 12/1983 |
| EP | 0081982 | B1 | 5/1985 |
| EP | 0277048 | B1 | 3/1988 |
| EP | 0390157 | B1 | 5/2000 |
| FR | 2780055 | A1 | 12/1999 |
| JP | 62120489 | A | 6/1987 |
| JP | 07258877 | A * | 10/1995 |
| JP | 2004344720 | A | 12/2004 |
| JP | 2006188370 | A | 7/2006 |
| JP | 2007185096 | A | 7/2007 |
| KR | 20040009875 | A | 1/2004 |
| WO | WO9850974 | A1 | 11/1998 |
| WO | WO 0015586 | A1 | 3/2000 |
| WO | WO0025380 | A2 | 5/2000 |
| WO | WO02059987 | A3 | 8/2002 |
| WO | WO 03004727 | A2 | 1/2003 |
| WO | WO 2004067673 | A1 | 8/2004 |
| WO | WO2007041872 | A1 | 4/2007 |
| WO | WO2007058608 | A1 | 5/2007 |
| WO | WO2007119260 | A2 | 10/2007 |
| WO | WO2008016728 | A2 | 2/2008 |
| WO | WO2008017838 | A1 | 2/2008 |
| WO | WO2008124538 | A1 | 10/2008 |
| WO | WO2009002566 | A1 | 12/2008 |
| WO | WO2009145624 | A1 | 12/2009 |

| | | | |
|---|---|---|---|
| WO | WO2010010252 | A2 | 1/2010 |
| WO | WO2010042197 | A1 | 4/2010 |
| WO | WO2010088524 | A2 | 8/2010 |
| WO | WO2010138792 | A1 | 12/2010 |
| WO | WO2011010109 | A1 | 1/2011 |
| WO | WO2011068743 | A2 | 6/2011 |
| WO | WO2011120021 | A1 | 9/2011 |
| WO | WO2011123907 | A1 | 10/2011 |
| WO | WO2011133264 | A1 | 10/2011 |

OTHER PUBLICATIONS

Scibioh et al., "Electrochemical Reduction of Carbon Dioxide: A Status Report", Proc Indian Natn Sci Acad (May 2004), vol. 70, A, No. 3, pp. 407-462.*

Shibata et al., "Electrochemical Synthesis of Urea at Gas-Diffusion Electrodes", J. Electrochem. Soc. (Jul. 1998), vol. 145, No. 7, pp. 2348-2353.*

Shibata et al., "Electrochemical Synthesis of Urea at Gas-Diffusion Electrodes Part VI. Simultaneous Reduction of Carbon Dioxide and Nitrite Ions with Various Metallophthalocyanine Catalysts", J. of Electroanalytical Chemistry (no month, 2001), vol. 507, pp. 177-184.*

Shibata, Masami, et al., "Simultaneous Reduction of Carbon Dioxide and Nitrate Ions at Gas-Diffusion Electrodes with Various Metallophthalocyanine Catalysts", From a paper presented at the 4th International Conference on 'Electrocatalysis: From Theory to Industrial Applications', Sep. 22-25, 2002, Como, Italy, Electrochimica Acta 48 (2003) 3953-3958.

R.P.S. Chaplin and A.A. Wragg; Effects of Process Conditions and Electrode Material on Reaction Pathways for Carbon Dioxide Electroreduction with Particular Refrences to Formate Formation; Journal of Applied Electrochemistry 33: pp. 1107-1123; © 2003 Kluwer Academic Publishers. Printed in the Netherlands.

Akahori, Iwanaga, Kato, Hamamoto, Ishii; New Electrochemical Process for CO2 Reduction to from Formic Acid from Combustion Flue Gases; Electrochemistry; vol. 4; pp. 266-270.

Ali, Sato, Mizukawa, Tsuge, Haga, Tanaka; Selective formation of HCO2- and C2O42—in electrochemical reduction of CO2 catalyzed by mono- and di-nuclear ruthenium complexes; Chemistry Communication; 1998; Received in Cambridge, UK, Oct. 13, 1997; 7/07363A; pp. 249-250.

Wang, Maeda, Thomas, Takanabe, Xin, Carlsson, Domen, Antonietti; A metal-free polymeric photocatalyst for hydrogen production from water under visible light; Nature Materials; Published Online Nov. 9, 2008; www.nature.com/naturematerials; pp. 1-5.

Aresta and Dibenedetto; Utilisation of CO2 as a Chemical Feedstock: Opportunities and Challenges; Dalton Transactions; 2007; pp. 2975-2992; © The Royal Society of Chemistry 2007.

B. Aurian-Blajeni, I. Taniguchi, and O'M. Bockris; Photoelectrochemical Reduction of Carbon Diozide Using Polyaniline-Coated Silicon; J. Electroanal. Chem.; vol. 149; 1983; pp. 291-293; Elsevier Sequoia S.A., Lausanne, Printed in The Netherlands.

Azuma, Hashimoto, Hiramoto, Watanabe, Sakata; Electrochemical Reduction of Carbon Dioxide on Various Metal Electrodes in Low-Temperature Aqueous KHCO3 Media; J. Electrochem. Soc., vol. 137, No. 6, Jun. 1990 © The Electrochemical Society, Inc.

Bandi and Kuhne; Electrochemical Reduction of Carbon Dioxide in Water: Analysis of Reaction Mechanism on Ruthenium-Titanium-Oxide; J. Electrochem. Soc., vol. 139, No. 6, Jun. 1992 © The Electrochemical Society, Inc.

Beley, Collin, Sauvage, Petit, Chartier; Photoassisted Electro-Reduction of CO2 on p-GaAs in the Presence of Ni Cyclam; J. Electroanal. Chem. vol. 206, 1986, pp. 333-339, Elsevier Sequoia S.A., Lausanne, Printed in The Netherlands.

Benson, Kubiak, Sathrum, and Smieja; Electrocatalytic and homogeneous approaches to conversion of CO2 to liquid fuels; Chem. Soc. Rev., 2009, vol. 38, pp. 89-99, © The Royal Society of Chemistry 2009.

Taniguchi, Aurian-Blajeni, and Bockris; The Mediation of the Photoelectrochemical Reduction of Carbon Dioxide by Ammonium Ions; J. Electroanal. Chem., vol. 161, 1984, pp. 385-388, Elsevier Sequoia S.A., Lausanne—Printed in The Netherlands.

Bockris and Wass; The Photoelectrocatalytic Reduction of Carbon Dioxide; J. Electrochem. Soc., vol. 136, No. 9, Sep. 1989, pp. 2521-2528, © The Electrochemical Society, Inc.

Carlos R. Cabrera and Hector D. Abruna; Electrocatalysis of CO2 Reduction at Surface Modified Metallic and Semiconducting Electrodes; J. Electronal. Chem. vol. 209, 1986, pp. 101-107, Elsevier Sequoia S.A., Lausanne—Printed in The Netherlands, © 1986 Elsevier Sequoia S.A.

D. Canfield and K.W. Frese, Jr.; Reduction of Carbon Dioxide to Methanol on n- and p-GaAs and p-InP. Effect of Crystal Face, Electrolyte and Current Density; Journal of the Electrochemical Society; Aug. 1983; pp. 1772-1773.

Huang, Lu, Zhao, Li and Wang; The Catalytic Role of N-Heterocyclic Carbene in a Metal-Free Conversion of Carbon Dioxide into Methanol: A Computational Mechanism Study; J. Am. Chem. Soc. 2010, vol. 132, pp. 12388-12396, © 2010 American Chemical Society.

Arakawa, et al., Catalysis Research of Relevance to Carbon Management: Progress, Challenges, and Opportunities; Chem. Rev. 2001, vol. 101, pp. 953-996.

Cheng, Blaine, Hill, and Mann; Electrochemical and IR Spectroelectrochemical Studies of the Electrocatalytic Reduction of Carbon Dioxide by [Ir2(dimen)4]2+ (dimen=1,8-Diisocyanomenthane), Inorg. Chem. 1996, vol. 35, pp. 7704-7708, © 1996 American Chemical Society.

Stephen K. Ritter; What Can We Do With Carbon DioxideΔ, Chemical & Engineering News, Apr. 30, 2007, vol. 85, No. 18, pp. 11-17, http://pubs.acs.org/cen/coverstory/85/8518cover.html.

J. Beck, R. Johnson, and T. Naya; Electrochemical Conversion of Carbon Dioxide to Hydrocarbon Fuels, EME 580 Spring 2010, pp. 1-42.

Aydin and Koleli, Electrochemical reduction of CO2 on a polyaniline electrode under ambient conditions and at high pressure in methanol, Journal of Electroanalytical Chemistry vol. 535 (2002) pp. 107-112, www.elsevier.com/locate/jelechem.

Lee, Kwon, Machunda, and Lee; Electrocatalytic Recycling of CO2 and Small Organic Molecules; Chem. Asian J. 2009, vol. 4, pp. 1516-1523, © 2009 Wiley-VCH Verlag GmbH&Co, KGaA, Weinheim.

Etsuko Fujita, Photochemical CO2 Reduction: Current Status and Future Prospects, American Chemical Society's New York Section, Jan. 15, 2011, pp. 1-29.

Toshio Tanaka, Molecular Orbital Studies on the Two-Electron Reduction of Carbon Dioxide to Give Formate Anion, Memiors of Fukui University of Technology, vol. 23, Part 1, 1993, pp. 223-230.

A. Bewick and G.P. Greener, The Electroreduction of CO2 to Glycollate on a Lead Cathode, Tetrahedron Letters No. 5, pp. 391-394, 1970, Pergamon Press, Printed in Great Britain.

Centi, Perathoner, Wine, and Gangeri, Electrocatalytic conversion of CO2 to long carbon-chain hydrocarbons, Green Chem., 2007, vol. 9, pp. 671-678, © The Royal Society of Chemistry 2007.

A. Bewick and G.P. Greener, The Electroreduction of CO2 to Malate on a Mercury Cathode, Tetrahedron Letters No. 53, pp. 4623-4626, 1969, Pergamon Press, Printed in Great Britain.

Eggins, Brown, McNeill, and Grimshaw. Carbon Dioxide Fixation by Electrochemical Reduction in Water to Oxalate and Glyoxylate, Tetrahedron Letters vol. 29, No. 8, pp. 945-948, 1988, Pergamon Journals Ltd., Printed in Great Britain.

Jean-Marie Lehn and Raymond Ziessel, Photochemical generation of carbon monoxide and hydrogen by reduction of carbon dioxide and water under visible light irradiation, Proc. Natl. Acad. Sci. USA, vol. 79, pp. 701-704, Jan. 1982, Chemistry.

Li and Prentice, Electrochemical Synthesis of Methanol from CO2 in High-Pressure Electrolyte, J. Electrochem. Soc., vol. 144, No. 12, Dec. 1997 © The Electrochemical Society, Inc., pp. 4284-4288.

Azuma, Hashimoto, Hiramoto, Watanabe, and Sakata; Carbon dioxide reduction at low temperature on various metal electrodes, J. Electroanal. Chem., 260 (1989) 441-445, Elsevier Sequoia S.A., Lausanne—Printed in The Netherlands.

Goettmann, Thomas, and Antonietti; Metal-Free Activation of CO2 by Mesoporous Graphitic Carbon Nitride; Angewandte Chemie; Angew. Chem. Int. Ed. 2007, 46, 2717-2720.

Yu B Vassiliev, V S Bagotzky, O.A. Khazova and NA Mayorova; Electroreduction of Carbon Dioxide Part II. The Mechanism of Reduction in Aprotic Solvents, J Electronal. Chem, 189 (1985) 295-309 Elsevier Sequoia S.A., Lausanne—Printed in The Netherlands.
Whipple, Finke, and Kenis; Microfluidic Reactor for the Electrochemical Reduction of Carbon Dioxide: The Effect of pH; Electrochemical and Solid-State Letters, 13 (9) B109-B111 (2010), 1099-0062/2010/13(9)/B109/3/$28.00 © The Electrochemical Society.
Zhai, Chiachiarelli, and Sridhar; Effects of Gaseous Impurities on the Electrochemical Reduction of CO2 on Copper Electrodes; ECS Transactions, 19 (14) 1-13 (2009), 10.1149/1.3220175 © The Electrochemical Society.
R.D.L. Smith, P.G. Pickup, Nitrogen-rich polymers for the electrocatalytic reduction of CO2, Electrochem. Commun. (2010), doi:10.1016/j.elecom.2010.10.013.
B.Z. Nikolic, H. Huang, D. Gervasio, A. Lin, C. Fierro, R.R. Adzic, and E.B. Yeager; Electroreduction of carbon dioxide on platinum single crystal electrodes: electrochemical and in situ FTIR studies; J. Electmanal. Chem., 295 (1990) 415-423; Elsevier Sequoia S.A., Lausanne.
Nogami, Itagaki, and Shiratsuchi; Pulsed Electroreduction of CO2 on Copper Electrodes—II; J. Electrochem. Soc., vol. 141, No. 5, May 1994 © The Electrochemical Society, Inc., pp. 1138-1142.
Ichiro Oda, Hirohito Ogasawara, and Masatoki Ito; Carbon Monoxide Adsorption on Copper and Silver Electrodes during Carbon Dioxide Electroreduction Studied by Infrared Reflection Absorption Spectroscopy and Surface-Enhanced Raman Spectroscopy; Langmuir 1996, 12, 1094-1097.
Kotaro Ogura,, Kenichi Mine, Jun Yano, and Hideaki Sugihara; Electrocatalytic Generation of C2 and C3 Compounds from Carbon Dioxide on a Cobalt Complex-immobilized Dual-film Electrode; J . Chem. Soc., Chem. Commun., 1993, pp. 20-21.
Ohkawa, Noguichi, Nakayama, Hashimoto, and Fujishima; Electrochemical reduction of carbon dioxide on hydrogen-storing materials Part 3. The effect of the absorption of hydrogen on the palladium electrodes modified with copper; Journal of Electroanalytical Chemistry, 367 (1994) 165-173.
Sanchez-Sanchez, Montiel, Tryk, Aldaz, and Fujishima; Electrochemical approaches to alleviation of the problem of carbon dioxide accumulation; Pure Appl. Chem., vol. 73, No. 12, pp. 1917-1927, 2001, © 2001 IUPAC.
D.J. Pickett and K. S. Yap, A study of the production of glyoxylic acid by the electrochemical reduction of oxalic acid solutions, Journal of Applied Electrochemistry 4 (1974) 17-23, Printed in Great Britain, © 1974 Chapman and Hall Ltd.
Bruce A. Parkinson & Paul F. Weaver, Photoelectrochemical pumping of enzymatic CO2 reduction, Nature, vol. 309, May 10, 1984, pp. 148-149.
Paul, Tyagi, Bilakhiya, Bhadbhade, Suresh, and Ramachandraiah; Synthesis and Characterization of Rhodium Complexes Containing 2,4,6-Tris(2-pyridyl)-1,3,5-triazine and Its Metal-Promoted Hydrolytic Products: Potential Uses of the New Complexes in Electrocatalytic Reduction of Carbon Dioxide; Inorg. Chem. 1998, 37, 5733-5742.
Furuya, Yamazaki, and Shibata; High performance Ru—Pd catalysts for CO2 reduction at gas-diffusion electrodes, Journal of Electroanalytical Chemistry 431 (1997) 39-41.
Petit, Chartier, Beley, and Deville; Molecular catalysts in photoelectrochemical cells Study of an efficient system for the selective photoelectroreduction of CO2: p-GaP or p-GaAs / Ni( cyclam) 2+, aqueous medium; J. Electroanal. Chem., 269 (1989) 267-281; Elsevier Sequoia S.A., Lausanne—Printed in The Netherlands.
Popic, Avramov-Ivic, and Vukovic; Reduction of carbon dioxide on ruthenium oxide and modified ruthenium oxide electrodes in 0.5 M NaHCO3, Journal of Electroanalytical Chemistry 421 (1997) 105-110.
Whipple and Kenis, Prospects of CO2 Utilization via Direct Heterogeneous Electrochemical Reduction, J. Phys. Chem. Lett. 2010, 1, 3451-3458, © 2010 American Chemical Society.
P.A. Christensen & S.J. Higgins, Preliminary note The electrochemical reduction of CO2 to oxalate at a Pt electrode immersed in acetonitrile and coated with polyvinylalcohol/[Ni(dppm)2Cl2], Journal of Electroanalytical Chemistry, 387 (1995) 127-132.
Qu, Zhang, Wang, and Xie; Electrochemical reduction of CO2 on RuO2/TiO2 nanotubes composite modified Pt electrode, Electrochimica Acta 50 (2005) 3576-3580.
Jin, Gao, Jin, Zhang, Cao, ; Wei, and Smith; High-yield reduction of carbon dioxide into formic acid by zero-valent metal/metal oxide redox cycles; Energy Environ. Sci., 2011, 4, pp. 881-884.
Yu B Vassiliev, V S Bagotzky. N. V Osetrova and A A Mikhailova; Electroreduction of Carbon Dioxide Part III. Adsorption and Reduction of CO2 on Platinum Metals; J Electroanal Chem. 189 (1985) 311-324, Elsevier Sequoia SA, Lausanne—Printed in The Netherlands.
M. Gattrell, N. Gupta, and A. Co; A review of the aqueous electrochemical reduction of CO2 to hydrocarbons at copper; Journal of Electroanalytical Chemistry 594 (2006) 1-19.
Hoshi, Ito, Suzuki, and Hori; Preliminary note CO 2 Reduction on Rh single crystal electrodes and the structural effect; Journal of Electroanalytical Chemistry 395 (1995) 309-312.
Rudolph, Dautz, and Jager; Macrocyclic [N42-] Coordinated Nickel Complexes as Catalysts for the Formation of Oxalate by Electrochemical Reduction of Carbon Dioxide; J. Am. Chem. Soc. 2000, 122, 10821-10830, Published on Web Oct. 21, 2000.
Ryu, Andersen, and Eyring; The Electrode Reduction Kinetics of Carbon Dioxide in Aqueous Solution; The Journal of Physical Chemistry, vol. 76, No. 22, 1972, pp. 3278-3286.
Zhao, Jiang, Han, Li, Zhang, Liu, Hi, and Wu; Electrochemical reduction of supercritical carbon dioxide in ionic liquid 1-n-butyl-3-methylimidazolium hexafluorophosphate; J. of Supercritical Fluids 32 (2004) 287-291.
Schwartz, Cook, Kehoe, MacDuff, Patel, and Sammells; Carbon Dioxide Reduction to Alcohols using Perovskite-Type Electrocatalysts; J. Electrochem. Soc., vol. 140, No. 3, Mar. 1993 © The Electrochemical Society, Inc., pp. 614-618.
Ikeda, Takagi, and Ito; Selective Formation of Formic Acid, Oxalic Acid, and Carbon Monoxide by Electrochemical Reduction of Carbon Dioxide; Bull. Chem. Soc. Jpn., 60, 2517-2522 (1987) © 1987 The Chemical Society of Japan.
Seshadri, Lin, and Bocarsly; A new homogeneous electrocatalyst for the reduction of carbon dioxide to methanol at low overpotential; Journal of Electroanalytical Chemistry, 372 (1994) 145-150.
Shiratsuchi, Aikoh, and Nogami; Pulsed Electroreduction of CO2 on Copper Electrodes; J, Electrochem. Soc., vol. 140, No. 12, Dec. 1993 © The Electrochemical Society, Inc.
Centi & Perathoner; Towards Solar Fuels from Water and CO2; ChemSusChem 2010, 3, 195-208, © 2010 Wiley-VCH Verlag GmbH& Co. KGaA, Weinheim.
David P. Summers, Steven Leach and Karl W. Frese Jr.; The Electrochemical Reduction of Aqueous Carbon Dioxide to Methanol at Molybdenum Electrodes With Low Overpotentials; J Electroanal. Chem., 205 (1986) 219-232, Elsevier Sequoia S.A., Lausanne—Printed in The Netherlands.
Isao Taniguchi, Benedict Aurian-Blajeni and John O'M. Bockris; Photo-Aided Reduction of Carbon Dioxide to Carbon Monoxide; J. Electroanal. Chem, 157 (1983) 179-182, Elsevier Sequoia S.A., Lausanne—Printed in The Netherlands.
Isao Taniguchi, Benedict Aurian-Blajeni and John O'M. Bockris; The Mediation of the Photoelectrochemical Reduction of Carbon Dioxide by Ammonium Ions; J. Electroanal. Chem, 161 (1984) 385-388, Elsevier Sequoia S.A., Lausanne—Printed in The Netherlands.
Hiroshi Yoneyama, Kenji Sugimura and Susumu Kuwabata; Effects of Electrolytes on the Photoelectrochemical Reduction of Carbon Dioxide at Illuminated p-Type Cadmium Telluride and p-Type Indium Phosphide Electrodes in Aqueous Solutions; J. Electroanal. Chem., 249 (1988) 143-153, Elsevier Sequoia ,S.A., Lausanne—Printed in The Netherlands.
Whipple, Finke, and Kenis; Microfluidic Reactor for the Electrochemical Reduction of Carbon Dioxide: The Effect of pH; Electrochemical and Solid-State Letters, 13 (9) B109-B111 (2010).
YLB Vassiliev, V S Bagotzky, N. V. Osetrov, O.A. Khazova and NA Mayorova; Electroreduction of Carbon Dioxide Part I. The Mechanism and Kinetics of Electroreduction of CO2 in Aqueous Solutions on Metals with High and Moderate Hydrogen Overvoltages; J Electroanal. Chem. 189 (1985) 271-294, Elsevier Sequoia SA, Lausanne—Printed in The Netherlands.

YLB Vassiliev, V S Bagotzky, N. V. Osetrov, O.A. Khazova and NA Mayorova; Electroreduction of Carbon Dioxide Part II. The Mechanism of Reduction in Aprotic Solvents; J Electroanal. Chem. 189 (1985) 295-309, Elsevier Sequoia SA , Lausanne—Printed in The Netherlands.
Watanabe, Shibata, Kato, Azuma, and Sakata; Design of Alloy Electrocatalysts for C02 Reduction III. The Selective and Reversible Reduction of C02 on Cu Alloy Electrodes; J. Electrochem. Soc., vol. 138, No. 11, Nov. 1991 © The Electrochemical Society, Inc., pp. 3382-3389.
Soichiro Yamamura, Hiroyuki Kojima, Jun Iyoda and Wasaburo Kawai; Photocatalytic Reduction of Carbon Dioxide with Metal-Loaded SiC Powders; J. Eleciroanal. Chem., 247 (1988) 333-337, Elsevier Sequoia S.A., Lausanne—Printed in The Netherlands.
R. Piercy, N. A. Hampson; The electrochemistry of indium, Journal of Applied Electrochemistry 5 (1975) 1-15, Printed in Great Britain, © 1975 Chapman and Hall Ltd.
C. K. Watanabe, K. Nobe; Electrochemical behaviour of indium in H2S04, Journal of Applied Electrochemistry 6 (1976) 159-162, Printed in Great Britain, © 1976 Chapman and Hall Ltd.
Yumi Akahori, Nahoko Iwanaga, Yumi Kato, Osamu Hamamoto, and Mikita Ishii; New Electrochemical Process for CO2 Reduction to from Formic Acid from Combustion Flue Gases; Electrochemistry; vol. 72, No. 4 (2004), pp. 266-270.
Hamamoto, Akahori, Goto, Kato, and Ishii; Modified Carbon Fiber Electrodes for Carbon Dioxide Reduction; Electrochemistry, vol. 72, No. 5 (2004), pp. 322-327.
S. Omanovicâ, M. Metikosï-Hukovic; Indium as a cathodic material: catalytic reduction of formaldehyde; Journal of Applied Electrochemistry 27 (1997) 35-41.
Hara, Kudo, and Sakata; Electrochemical reduction of carbon dioxide under high pressure on various electrodes in an aqueous electrolyte; Journal of Electroanalytical Chemistry 391 (1995) 141-147.
Nara et al., "Electrochemical Reduction of Carbon Dioxide Under High Pressure on Various Electrodes in an Aqueous Electrolyte", Journal of Electroanalytical Chemistry (no month, 1995), vol. 391, pp. 141-147.
Yamamoto et al., "Production of Syngas Plus Oxygen From CO2 in a Gas-Diffusion Electrode-Based Electrolytic Cell", Electrochimica Acta (no month, 2002), vol. 47, pp. 3327-3334.
Seshadri et al., "A New Homogeneous Electrocatalyst for the Reduction of Carbon Dioxide to Menthanol at Low Overpotential", Journal of Electroanalytical Chemistry, 372 pp. 145-150, Jul. 8, 1994, figure 1; p. 146-147.
Doherty, "Electrochemical Reduction of Butyraldehyde in the Presence of CO2", Electrochimica Acta 47(2002) 2963-2967.
Udupa et al., "The Electrolytic Reduction of Carbon Dioxide to Formic Acid", Electrochimica Acta (no month, 1971), vol. 16, pp. 1593-1598.
Jitaru, Maria, "Electrochemical Carbon Dioxide Reduction"—Fundamental and Applied Topics (Review), Journal of the University of Chemical Technology and Metallurgy (2007), vol. 42, No. 4, pp. 333-344.
Sloop et al., "The Role of Li-ion Battery Electrolyte Reactivity in Performance Decline and Self-Discharge", Journal of Power Sources (no month, 2003), vols. 119-121, pp. 330-337.
Shibata, Masami, et al., "Electrochemical Synthesis of Urea at Gas-Diffusion Electrodes", J. Electrochem. Soc., vol. 145, No. 2, Feb. 1998, pp. 595-600, The Electrochemical Society, Inc.
Shibata, Masami, et al., "Simultaneous Reduction of Carbon Dioxide and Nitrate Ions at Gas-Diffusion Electrodes with Various Metallophthalocyanine Catalysts", From a paper presented at the 4th International Conference on Electrocatalysis: From Theory to Industrial Applications, Sep. 22-25, 2002, Como, Italy, Electrochimica Acta 48 (2003) 3959-3958.
Harrison et al., "The Electrochemical Reduction of Organic Acids", Electroanalytical Chemistry and Interfacial Electrochemistry (no month, 1971), vol. 32, No. 1, pp. 125-135.
Chauhan et al., "Electro Reduction of Acetophenone in Pyridine on a D.M.E.", J Inst. Chemists (India) [Jul. 1983], vol. 55, No. 4, pp. 147-148.
Hori et al, chapter on "Electrochemical CO2 Reduction on Metal Electrodes," in the book Modern Aspects of Electrochemistry, vol. 42, pp. 106 and 107.
Czerwinski et al, "Adsorption Study of CO2 on Reticulated Vitreous Carbon (RVC) covered with Platinum," Analytical Letters, vol. 18, Issue 14 (1985), pp. 1717-1722.
Jitaru, Lowy, Toma, Toma and Oniciu, "Electrochemical Reduction of Carbon Dioxide on Flat Metallic Cathodes," Journal of Applied Electrochemistry, 1997, vol. 27, p. 876.
Popic, Avramov, and Vukovic, "Reduction of Carbon Dioxide on Ruthenium Oxide and Modified Ruthenium Oxide Electrodes in 0.5M NaHCO3," Journal of Electroanalytical Chemistry, 1997, vol. 421, pp. 105-110.
Eggins and McNeill, "Voltammetry of Carbon Dioxide. I. A General Survey of Voltammetry at Different Electrode Materials in Different Solvents," Journal of Electroanalytical Chemistry, 1983, vol. 148, pp. 17-24.
Kostecki and Augustynski, "Electrochemical Reduction of CO2 at an Active Silver Electrode," Ber. Busenges. Phys. Chem., 1994, vol. 98, pp. 1510-1515.
Non-Final Office Action for U.S. Appl. No. 12/846,221, dated Nov. 21, 2012.
Non-Final Office Action for U.S. Appl. No. 12/846,011, dated Aug. 29, 2011.
Non-Final Office Action for U.S. Appl. No. 12/846,002, dated Sep. 11, 2012.
Non-Final Office Action for U.S. Appl. No. 12/845,995, dated Aug. 13, 2012.
Final Office Action for U.S. Appl. No. 12/845,995, dated Nov. 28, 2012.
Non-Final Office Action for U.S. Appl. No. 12/696,840, dated Jul. 9, 2012.
Non-Final Office Action for U.S. Appl. No. 13/472,039, dated Sep. 13, 2012.
DNV (Det Norske Veritas), Carbon Dioxide Utilization, Electrochemical Conversion of CO2—Opportunities and Challenges, Research and Innovation, Position Paper, Jul. 2011.
Matthew R. Hudson, Electrochemical Reduction of Carbon Dioxide, Department of Chemistry, State University of New York at Potsdam, Potsdam New York 13676, pp. 1-15, Dec. 9, 2005.
Colin Oloman and Hui Li, Electrochemical Processing of Carbon Dioxide, ChemSusChem 2008, 1, 385-391, (c) 2008 Wiley-VCH Verlag GmbH& Co. KGaA, Weinheim, www.chemsuschem.org.
Shibata et al., "Simultaneous Reduction of Carbon Dioxide and Nitrate Ions at Gas-Diffusion Electrodes with Various Metallophthalocyanine Catalysts", Electrochima Acta (no month, 2003), vol. 48, pp. 3953-3958.
Non-Final Office Action for U.S. Appl. No. 12/875,227, dated Dec. 11, 2012.
Stephen K. Ritter, What Can We Do With Carbon Dioxide? Scientists are trying to find ways to convert the plentiful greenhouse gas into fuels and other value-added products, Chemical & Engineering News, Apr. 30, 2007, vol. 85, No. 18, pp. 11-17, http://pubs.acs.org/cen/coverstory/85/8518cover.html.
Toshio Tanaka, Molecular Orbital Studies on the Two-Electron Reduction of Carbon Dioxide to Give Formate Anion, Memoirs of Fukui University of Technology, vol. 23, Part 1, 1993, pp. 223-230.
Columbia, Crabtree, and Thiel; The Temperature and Coverage Dependences of Adsorbed Formic Acid and Its Conversion to Formate on Pt(111), J. Am. Chem. Soc., vol. 114, No. 4, 1992, pp. 1231-1237.
Brian R. Eggins and Joanne McNeill, Voltammetry of Carbon Dioxide, Part I. A General Survey of Voltammetry At Different Electrode Materials in Different Solvents, J. Electroanal. Chem., 148 (1983) 17-24, Elsevier Sequoia S.A., Lausanne—Printed in The Netherlands.
Varghese, Paulose, Latempa, and Grimes; High-Rate Solar Photocatalytic Conversion of CO2 and Water Vapor to Hydrocarbon Fuels; Nano Letters, 2009, vol. 9, No. 2, pp. 731-737.
Han, Chu, Kim, Song, and Kim; Photoelectron spectroscopy and ab initio study of mixed cluster anions of [(CO21-3(Pyridine)1-6: Formation of a covalently bonded anion core of (C5H5N—CO2), Journal of Chemical Physics, vol. 113, No. 2, Jul. 8, 2000, pp. 596-601.

Heinze, Hempel, and Beckmann; Multielectron Storage and Photo-Induced Electron Transfer in Oligonuclear Complexes Containing Ruthenium(II) Terpyridine and Ferrocene Building Blocks, Eur. J. Inorg. Chem. 2006, 2040-2050.
Lin and Frei, Bimetallic redox sites for photochemical CO2 splitting in mesoporous silicate sieve, C. R. Chimie 9 (2006) 207-213.
Heyduk, MacIntosh, and Nocera; Four-Electron Photochemistry of Dirhodium Fluorophosphine Compounds, J. Am. Chem. Soc. 1999, 121, 5023-5032.
Witham, Huang, Tsung, Kuhn, Somorjai, and Toste; Converting homogeneous to heterogeneous in electrophilic catalysis using monodisperse metal nanoparticles, Nature Chemistry, DOI: 10.1038/NCHEM.468, pp. 1-6, 2009.
Hwang and Shaka, Water Suppression That Works. Excitation Sculpting Using Arbitrary Waveforms and Pulsed Field Gradients, Journal of Magnetic Resonance, Series A 112, 275-279 (1995).
Weissermel and Arpe, Industrial Organic Chemistry, 3rd Edition 1997, Published jointly by VCH Verlagsgesellschaft mbH, Weinheim (Federal Republic of Germany) VCH Pubiishers, Inc., New York, NY (USA), pp. 1-481.
T. Iwasita, . C. Nart, B. Lopez and W. Vielstich; On the Study of Adsorbed Species at Platinum From Methanol, Formic Acid and Reduced Carbon Dioxide Via In Situ FT-ir Spectroscopy, Electrochimica Atca, vol. 37. No. 12. pp. 2361-2367, 1992, Printed in Great Britain.
Lackner, Grimes, and Ziock; Capturing Carbon Dioxide From Air; pp. 1-15.
Kang, Kim, Lee, Hong, and Moon; Nickel-based tri-reforming catalyst for the production of synthesis gas, Applied Catalysis, A: General 332 (2007) 153-158.
Kostecki and Augustynski, Electrochemical Reduction of CO2 at an Activated Silver Electrode, Ber. Bunsenges. Phys. Chem. 98, 1510-1515 (1994) No. I2 C VCH Verlagsgesellschaft mbH, 0-69451 Weinheim, 1994.
Kunimatsu and Kita; Infrared Spectroscopic Study of Methanol and Formic Acid Adsorrates on a Platinum Electrode, Part II. Role of the Linear CO(a) Derived From Methanol and Formic Acid in the Electrocatalytic Oxidation of CH,OH and HCOOH, J Electroanal Chem., 218 (1987) 155-172, Elsevier Sequoia S A , Lausanne—Printed in The Netherlands.
Lichter and Roberts, 15N Nuclear Magnetic Resonance Spectroscopy. XIII. Pyridine-15N1, Journal of the American Chemical Society 1 93:20 1 Oct. 6, 1971, pp. 5218-5224.
R.J.L. Martin, The Mechanism of the Cannizzaro Reaction of Formaldehyde, May 28, 1954, pp. 335-347.
Fujitani, Nakamura, Uchijima, and Nakamura; The kinetics and mechanism of methanol synthesis by hydrogenation of CO2 over a Zn-deposited Cu(111surface, Surface Science 383 (1997) 285-298.
Richard S. Nicholson and Irving Shain, Theory of Stationary Electrode Polarography, Single Scan and Cyclic Methods Applied to Reversible, Irreversible, and Kinetic Systems, Analytical Chemistry, vol. 36, No. 4, April 1964, pp. 706-723.
Noda, Ikeda, Yamamoto, Einaga, and Ito; Kinetics of Electrochemical Reduction of Carbon Dioxide on a Gold Electrode in Phosphate Buffer Solutions; Bull. Chem. Soc. Jpn., 68, 1889-1895 (1995).
Joseph W. Ochterski, Thermochemistry in Gaussian, (c)2000, Gaussian, Inc., Jun. 2, 2000, 19 Pages.
Kotaro Ogura and Mitsugu Takagi, Electrocatalytic Reduction of Carbon Dioxide to Methanol, Part IV. Assessment of the Current-Potential Curves Leading to Reduction, J. Electroanal. Chem., 206 (1986) 209-216, Elsevier Sequoia S.A., Lausanne—Printed in The Netherlands.
Ohkawa, Noguchi, Nakayama, Hashimoto, and Fujishima; Electrochemical reduction of carbon dioxide on hydrogen-storing materials, Part 3. The effect of the absorption of hydrogen on the palladium electrodes modified with copper; Journal of Electroanalytical Chemistry, 367 (1994) 165-173.
Ohmstead and Nicholson, Cyclic Voltammetry Theory for the Disproportionation Reaction and Spherical Diffusion, Analytical Chemistry, vol. 41, No. 6, May 1969, pp. 862-864.
Shunichi Fukuzumi, Bioinspired Energy Conversion Systems for Hydrogen Production and Storage, Eur. J. Inorg. Chem. 2008, 1339-1345.
Angamuthu, Byers, Lutz, Spek, and Bouwman; Electrocatalytic CO2 Conversion to Oxalate by a Copper Complex, Science, vol. 327, Jan. 15, 2010, pp. 313-315.
J. Fischer, Th. Lehmann, and E. Heitz; The production of oxalic acid from C02 and H2O, Journal of Applied Electrochemistry 11 (1981) 743-750.
Rosenthal, Bachman, Dempsey, Esswein, Gray, Hodgkiss, Manke, Luckett, Pistorio, Veige, and Nocera; Oxygen and hydrogen photocatalysis by two-electron mixed-valence coordination compounds, Coordination Chemistry Reviews 249 (2005) 1316-1326.
Rudolph, Dautz, and Jager; Macrocyclic [N42-] Coordinated Nickel Complexes as Catalysts for the Formation of Oxalate by Electrochemical Reduction of Carbon Dioxide, J. Am. Chem. Soc. 2000, 122, 10821-10830.
D.A. Shirley, High-Resolution X-Ray Photoemission Spectrum of the Valence Bands of Gold, Physical Review B, vol. 5, No. 12, Jun. 15, 1972, pp. 4709-4714.
S.G. Sun and J. Clavilier, The Mechanism of Electrocatalytic Oxidation of Formic Acid on Pt (100) and Pt (111) in Sulphuric Acid Solution: An Emirs Study, J. Electroanal. Chem., 240 (1988) 147-159, Elsevier Sequoia S.A., Lausanne—Printed in The Netherlands.
Sun, Lin, Li, and Mu; Kinetics of dissociative adsorption of formic acid on Pt(100), Pt(610), Pt(210), and Pt(110) single-crystal electrodes in perchloric acid solutions, Journal of Electroanalytical Chemistry, 370 (1994) 273-280.
Marek Szklarczyk, Jerzy Sobkowski and Jolanta Pacocha, Adsorption and Reduction of Formic Acid on p-Type Silicon Electrodes, J. Electroanal. Chem., 215 (1986) 307-316, Elsevier Sequoia S.A., Lausanne—Printed in The Netherlands.
Zhao, Fan, and Wang, Photo-catalytic CO2 reduction using sol-gel derived titania-supported zinc-phthalocyanine, Journal of Cleaner Production 15 (2007) 1894-1897.
Tanaka and Ooyama, Multi-electron reduction of CO2 via Ru—CO2, -C(O)OH, -CO, -CHO, and -CH2OH species, Coordination Chemistry Reviews 226 (2002) 211-218.
Toyohara, Nagao, Mizukawa, and Tanaka, Ruthenium Formyl Complexes as the Branch Point in Two- and Multi-Electron Reductions of CO2, Inorg. Chem. 1995, 34, 5399-5400.
Watanabe, Shibata, and Kato; Design of Ally Electrocatalysts for CO2 Reduction, III. The Selective and Reversible Reduction of CO2 on Cu Alloy Electrodes; J. Electrochem. Soc., vol. 138, No. 11, Nov. 1991, pp. 3382-3389.
Dr. Chao Lin, Electrode Surface Modification and its Application to Electrocatalysis, V. Catalytic Reduction of Carbon Dioxide to Methanol, Thesis, 1992, Princeton University, pp. 157-179.
Dr. Gayatri Seshadri, Part I. Electrocatalysis at modified semiconductor and metal electrodes; Part II. Electrochemistry of nickel and cadmium hexacyanoferrates, Chapter 2—The Electrocatalytic Reduction of CO2 to Methanol at Low Overpotentials, 1994, Princeton University, pp. 52-85.
Cook, MacDuff, and Sammells; High Rate Gas Phase CO2 Reduction to Ethylene and Methane Using Gas Diffusion Electrodes, J. Electrochem. Soc., vol. 137, No. 2, pp. 607-608, Feb. 1990, © The Electrochemical Society, Inc.
Daube, Harrison, Mallouk, Ricco, Chao, Wrighton, Hendrickson, and Drube; Electrode-Confined Catalyst Systems for Use in Optical-to-Chemical Energy Conversion; Journal of Photochemistry, vol. 29, 1985, pp. 71-88.
Dewulf, Jin, and Bard; Electrochemical and Surface Studies of Carbon Dioxide Reduction to Methane and Ethylene at Copper Electrodes in Aqueous Solutions; J. Electrochem. Soc., vol. 136, No. 6, Jun. 1989, pp. 1686-1691, © The Electrochemical Society, Inc.
J. Augustynski, P. Kedzierzawski, and B. Jermann, Electrochemical Reduction of CO2 at Metallic Electrodes, Studies in Surface Science and Catalysis, vol. 114, pp. 107-116, © 1998 Elsevier Science B.V.
Sung-Woo Lee, Jea-Keun Lee, Kyoung-Hag Lee, and Jun-Heok Lim, Electrochemical reduction of CO2 and H2 from carbon dioxide in aqua-solution, Current Applied Physics, vol. 10, 2010, pp. S51-S54.
Andrew P. Abbott and Christopher A. Eardley, Electrochemical Reduction of CO2 in a Mixed Supercritical Fluid, J. Phys. Chem. B, 2000, vol. 104, pp. 775-779.
Matthew R. Hudson, Electrochemical Reduction of Carbon Dioxide, Dec. 9, 2005, pp. 1-15.

S. Kapusta and N. Hackerman, The Electroreduction of Carbon Dioxide and Formic Acid on Tin and Indium Electrodes, J. Electrochem. Soc.: Electrochemical Science and Technology, Mar. 1983, pp. 607-613.
M Aulice Scibioh and B Viswanathan, Electrochemical Reduction of Carbon Dioxide: A Status Report, Proc Indian Natn Sci Acad, vol. 70, A, No. 3, May 2004, pp. 1-56.
N. L. Weinberg, D. J. Mazur, Electrochemical hydrodimerization of formaldehyde to ethylene glycol, Journal of Applied Electrochemistry, vol. 21, 1991, pp. 895-901.
R.P.S. Chaplin and A.A. Wragg, Effects of process conditions and electrode material on reaction pathways for carbon dioxide electroreduction with particular reference to formate formation, Journal of Applied Electrochemistry vol. 33, pp. 1107-1123, 2003, © 2003 Kluwer Academic Publishers. Printed in the Netherlands.
M.N. Mahmood, D. Masheder, and C.J. Harty, Use of gas-diffusion electrodes for high-rate electrochemical reduction of carbon dioxide. I. Reduction at lead, indium- and tin-impregnated electrodes, Journal of Applied Electrochemistry, vol. 17, 1987, pp. 1159-1170.
Summers, Leach, and Frese, The Electrochemical Reduction of Aqueous Carbon Dioxide to Methanol at Molybdenum Electrodes with Low Overpotentials, J. Electroanal. Chem., vol. 205, 1986, pp. 219-232, Elseiver Sequoia S.A., Lausanne—Printed in The Netherlands.
Frese and Leach, Electrochemical Reduction of Carbon Dioxide to Methane, Methanol, and CO on Ru Electrodes, Journal of the Electrochemical Society, Jan. 1985, pp. 259-260.
Frese and Canfield, Reduction of CO2 on n-GaAs Electrodes and Selective Methanol Synthesis, J. Electrochem. Soc.: Electrochemical Science and Technology, vol. 131, No. 11, Nov. 1984, pp. 2518-2522.
Shibata, Yoshida, and Furuya, Electrochemical Synthesis of Urea at Gas-Diffusion Electrodes, J. Electrochem. Soc., vol. 145, No. 2, Feb. 1998, © The Electrochemical Society, Inc., pp. 595-600.
Shibata and Furuya, Simultaneous reduction of carbon dioxide and nitrate ions at gas-diffusion electrodes with various metallophthalocyanine catalysts, Electrochimica Acta 48, 2003, pp. 3953-3958.
M. Gattrell, N. Gupta, and A. Co, A Review of the aqueous electrochemical reduction of CO2 to hydrocarbons at copper, Journal of Electroanalytical Chemistry, vol. 594, 2006, pp. 1-19.
Mahmood, Masheder, and Harty; Use of Gas-Diffusion Electrodes for High-Rate Electrochemical Reduction of Carbon Dioxide. II. Reduction at Metal Phthalocyanine-impregnated Electrodes; Journal of Applied Electrochemistry, vol. 17, 1987, pp. 1223-1227.
Gennaro, Isse, Saveant, Severin, and Vianello; Homogeneous Electron Transfer Catalysis of the Electrochemical Reduction of Carbon Dioxide. Do Aromatic Anion Radicals React in an Outer-Sphere Manner?; J. Am. Chem. Soc., 1996, vol. 118, pp. 7190-7196.
J. Giner, Electrochemical Reduction of CO2 on Platinum Electrodes in Acid Solutions, Electrochimica Acta, 1963, vol. 8, pp. 857-865, Pregamon Press Ltd., Printed in Northern Ireland.
John Leonard Haan, Electrochemistry of Formic Acid and Carbon Dioxide on Metal Electrodes with Applications to Fuel Cells and Carbon Dioxide Conversion Devices, 2010, pp. 1-205.
M. Halmann, Photoelectrochemical reduction of aqueous carbon dioxide on p-type gallium phosphide in liquid junction solar cells, Nature, vol. 275, Sep. 14, 1978, pp. 115-116.
H. Ezaki, M. Morinaga, and S. Watanabe, Hydrogen Overpotential for Transition Metals and Alloys, and its Interpretation Using an Electronic Model, Electrochimica Acta, vol. 38, No. 4, 1993, pp. 557-564, Pergamon Press Ltd., Printed in Great Britain.
K.S. Udupa, G.S. Subramanian, and H.V.K. Udupa, The Electrolytic Reduction of Carbon Dioxide to Formic Acid, Electrochimica Acta, 1971, vol. 16, pp. 1593-1598, Pergamon Press., Printed in Northern Ireland.
Ougitani, Aizawa, Sonoyama, and Sakata; Temperature Dependence of the Probability of Chain Growth for Hydrocarbon Formation by Electrochemical Reduction of CO2, Bull. Chem. Soc. Jpn., vol. 74, pp. 2119-2122, 2001.
Furuya, Yamazaki, and Shibata; High performance Ru—Pd catalysts for CO2 reduction at gas-diffusion electrodes, Journal of Electroanalytical Chemistry, vol. 431, 1997, pp. 39-41.
R. Hinogami, Y. Nakamura, S. Yae, and Y. Nakato; An Approach to Ideal Semiconductor Electrodes for Efficient Photoelectrochemical Reduction of Carbon Dioxide by Modification with Small Metal Particles, J. Phys. Chem. B, 1998, vol. 102, pp. 974-980.
Reda, Plugge, Abram, and Hirst; Reversible interconversion of carbon dioxide and formate by an electroactive enzyme, PNAS, Aug. 5, 2008, vol. 105, No. 31, pp. 10654-10658, www.pnas.org/cgi/doi/10.1073pnas.0801290105.
Y. Hori, Electrochemical CO2 Reduction on Metal Electrodes, Modern Aspects of Electrochemistry, No. 42, edited by C. Vayenas et al., Springer, New York, 2008, pp. 89-189.
Hori, Yoshio; Suzuki, Shin, Cathodic Reduction of Carbon Dioxide for Energy Storage, Journal of the Research Institute for Catalysis Hokkaido University, 30(2): 81-88, 1983-02, http://hdl.handle.net/2115/25131.
Hori, Wakebe, Tsukamoto, and Koga; Electrocatalytic Process of CO Selectivity in Electrochemical Reduction of CO2 at Metal Electrodes in Aqueous Media, Electrochimica Acta, vol. 39, No. 11/12, pp. 1833-1839, 1994, Copyright 1994 Elsevier Science Ltd.,Pergamon, Printed in Great Britain.
Hori, Kikuchi, and Suzuki; Production of CO and CH4 in Electrochemical Reduction of CO2 at Metal Electrodes in Aqueous Hydrogencarbonate Solution; Chemistry Letters, 1985, pp. 1695-1698, Copyright 1985 The Chemical Society of Japan.
Hori, Kikuchi, Murata, and Suzuki; Production of Methane and Ethylene in Electrochemical Reduction of Carbon Dioxide at Copper Electrode in Aqueous Hydrogencarbonate Solution; Chemistry Letters, 1986, pp. 897-898, Copyright 1986 The Chemical Society of Japan.
Hoshi, Suzuki, and Hori; Step Density Dependence of CO2 Reduction Rate on Pt(S)-[n(111) x (111)] Single Crystal Electrodes, Electrochimica Acta, vol. 41, No. 10, pp. 1617-1653, 1996, Copyright 1996 Elsevier Science Ltd. Printed in Great Britain.
Hoshi, Suzuki, and Hori; Catalytic Activity of CO2 Reduction on Pt Single-Crystal Electrodes: Pt(S)-[n(111)x(111)], Pt(S)-[n(111)x(100)], and Pt(S)-[n(100)x(111)], J. Phys. Chem. B, 1997, vol. 101, pp 8520-8524.
Ikeda, Saito, Yoshida, Noda, Maeda, and Ito; Photoelectrochemical reduction products of carbon dioxide at metal coated p-GaP photocathodes in non-aqueous electrolytes, J. Electroanal. Chem., 260 (1989) pp. 335-345, Elsevier Sequoia S.A., Lausanne—Printed in The Netherlands.
Noda, Ikeda, Oda, Imai, Maeda, and Ito; Electrochemical Reduction of Carbon Dioxide at Various Metal Electrodes in Aqueous Potassium Hydrogen Carbonate Solution, Bull. Chem. Soc. Jpn., 63, pp. 2459-2462, 1990, Copyright 1990 The Chemical Society of Japan.
S.R. Narayanan, B. Haines, J. Soler, and T.I. Valdez; Electrochemical Conversion of Carbon Dioxide to Formate in Alkaline Polymer Electrolyte Membrane Cells, Journal of the Electrochemical Society, 158 (2) A167-A173 (2011).
Tooru Inoue, Photoelectrocatalytic reduction of carbon dioxide in aqueous suspensions of semiconductor powders, Nature, vol. 277, Feb. 22, 1979, pp. 637-638.
B. Jermann and J. Augustynski, Long-Term Activation of the Copper Cathode in the Course of CO2 Reduction, Electrochimica Acta, vol. 39, No. 11/12, pp. 1891-1896, 1994, Elsevier Science Ltd., Printed in Great Britain.
Jitaru, Lowy, M. Toma, B.C. Toma, and L. Oniciu; Electrochemical reduction of carbon dioxide on flat metallic cathodes; Journal of Applied Electrochemistry 27 (1997) 875-889, Reviews in Applied Electrochemistry No. 45.
Maria Jitaru, Electrochemical Carbon Dioxide Reduction-Fundamental and Applied Topics (Review), Journal of the University of Chemical Technology and Metallurgy, 42, 4, 2007, 333-344.
Kaneco, Katsumata, Suzuki, and Ohta; Photoelectrocatalytic reduction of CO2 in LiOH/methanol at metal-modified p-InP electrodes, Applied Catalysis B: Environmental 64 (2006) 139-14.
J.J. Kim, D.P. Summers, and K.W. Frese, Jr; Reduction of CO2 and CO to Methane on Cu Foil Electrodes, J. Electroanal. Chem., 245 (1988) 223-244, Elsevier Sequoia S.A., Lausanne—Printed in The Netherlands.

Osamu Koga and Yoshio Hori, Reduction of Adsorbed CO on a Ni Electrode in Connection With the Electrochemical Reduction of CO2, Electrochimica Acta, vol. 38, No. 10, pp. 1391-1394,1993, Printed in Great Britain.
Breedlove, Ferrence, Washington, and Kubiak; A photoelectrochemical approach to splitting carbon dioxide for a manned mission to Mars, Materials and Design 22 (2001) 577-584, © 2001 Elsevier Science Ltd.
Simon-Manso and Kubiak, Dinuclear Nickel Complexes as Catalysts for Electrochemical Reduction of Carbon Dioxide, Organometallics 2005, 24, pp. 96-102, © 2005 American Chemical Society.
Kushi, Nagao, Nishioka, Isobe, and Tanaka; Remarkable Decrease in Overpotential of Oxalate Formation in Electrochemical CO2 Reduction by a Metal-Sulfide Cluster, J. Chem. Soc., Chem. Commun., 1995, pp. 1223-1224.
Kuwabata, Nishida, Tsuda, Inoue, and Yoneyama; Photochemical Reduction of Carbon Dioxide to Methanol Using ZnS Microcrystallite as a Photocatalyst in the Presence of Methanol Dehydrogenase, J. Electrochem. Soc., vol. 141, No. 6, pp. 1498-1503, Jun. 1994, © The Electrochemical Society, Inc.
Hori, Kikuchi, and Suzuki; Production of CO and CH4 in Electrochemical Reduction of CO2 at Metal Electrodes in Aqueous Hydrogencarbonate Solution; Chemistry Letters, pp. 1695-1698, 1985. (C) 1985 The Chemical Society of Japan.
Jitaru, Lowy, M. Toma, B.C. Toma, Oniciu; Electrochemical reduction of carbon dioxide on flat metallic cathodes; Journal of Applied Electrochemistry 27 (1997) pp. 875-889, Reviews in Applied Electrochemistry No. 45.
Kaneco, Iwao, Iiba, Itoh, Ohta, and Mizuno; Electrochemical Reduction of Carbon Dioxide on an Indium Wire in a KOH/Methanol-Based Electrolyte at Ambient Temperature and Pressure; Environmental Engineering Science; vol. 16, No. 2, 1999, pp. 131-138.
Todoroki, Hara, Kudo, and Sakata; Electrochemical reduction of high pressure CO2 at Pb, Hg and In electrodes in an aqueous KHCO3 solution; Journal of Electroanalytical Chemistry 394 (1995) 199-203.
R.P.S. Chaplin and A.A. Wragg, Effects of process conditions and electrode material on reaction pathways for carbon dioxide electroreduction with particular reference to formate formation, Journal of Applied Electrochemistry 33: 1107-1123, 2003, Copyright 2003 Kluwer Academic Publishers. Printed in the Netherlands.
Kapusta and Hackerman; The Electroreduction of Carbon Dioxide and Formic Acid on Tin and Indium Electrodes, J. Electrochem. Doc.: Electrochemical Science and Technology, vol. 130, No. 3 Mar. 1983, pp. 607-613.
M. N. Mahmood, D. Masheder, and C. J. Harty; Use of gas-diffusion electrodes for high-rate electrochemical reduction of carbon dioxide. I. Reduction at lead, indium- and tin-impregnated electrodes; Journal of Applied Electrochemistry 17 (1987) 1159-1170.
Yoshio Hori, Hidetoshi Wakebe, Toshio Tsukamoto and Osamu Koga; Electrocatalytic Process of CO Selectivity in Electrochemical Reductionof CO2 at Metal Electrodes in Aqueous Media; Electrochimica Acta, vol. 39, No. 11/12, pp. 1833-1839, 1994, Copyright 1994 Elsevier Science Ltd., Printed in Great Britain.
Noda, Ikeda, Oda, Imai, Maeda, and Ito; Electrochemical Reduction of Carbon Dioxide at Various Metal Electrodes in Aqueous Potassium Hydrogen Carbonate Solution; Bull. Chem. Soc. Jpn., 63, 2459-2462, 1990, Copyright 1990 The Chemical Society of Japan.
Azuma, Hashimoto, Hiramoto, Watanbe, and Sakata; Carbon dioxide reduction at low temperature on various metal electrodes; J. Electroanal. Chem., 260 (1989) 441-445, Elsevier Sequioa S.A., Lausanne—Printed in The Netherlands.
Vassiliev, Bagotzky, Khazova, and Mayorova; Electroreduction of Carbon Dioxide, Part II. The Mechanism of Reduction in Aprotic Solvents, J. Electroanal. Chem. 189 (1985) 295-309, Elsevier Sequoia S.A., Lausanne—Printed in The Netherlands.
Vassiliev, Bagotzky, Khazova, and Mayorova; Electroreduction of Carbon Dioxide, Part I. The Mechanism and Kinetics of Electroreduction of CO2 in Aqueous Solutions on Metals with High and Moderate Hydrogen Overvoltages, J. Electroanal. Chem. 189 (1985) 271-294, Elsevier Sequoia S.A., Lausanne—Printed in The Netherlands.
Ikeda, Takagi, and Ito; Selective Formation of Formic Acid, Oxalic Acid, and Carbon Monoxide by Electrochemical Reduction of Carbon Dioxide, Bull. Chem. Soc. Jpn., 60, 2517-2522.
Shibata, Yoshida, and Furuya; Electrochemical Synthesis of Urea at Gas-Diffusion Electrodes, IV. Simultaneous Reduction of Carbon Dioxide and Nitrate Ions with Various Metal Catalysts; J. Electrochem. Soc., vol. 145, No. 7, Jul. 1998 The Electrochemical Society, Inc., pp. 2348-2353.
F. Richard Keene, Electrochemical and Electrocatalytic Reactions of Carbon Dioxide—Chapter 1: Thermodynamic, Kinetic, and Product Considerations in Carbon Dioxide Reactivity, Elsevier, Amsterdam, 1993, pp. 1-17.
Sammells and Cook, Electrochemical and Electrocatalytic Reactions of Carbon Dioxide—Chapter 7: Electrocatalysis and Novel Electrodes for High Rate CO2 Reduction Under Ambient Conditions, Elsevier, Amsterdam, 1993, pp. 217-262.
W.W. Frese, Jr., Electrochemical and Electrocatalytic Reactions of Carbon Dioxide—Chapter 6: Electrochemical Reduction of CO2 at Solid Electrodes, Elsevier, Amsterdam, 1993, pp. 145-215.
Halmann and Steinberg, Greenhouse gas carbon dioxide mitigation: science and technology—Chapter 11: Photochemical and Radiation-Induced Activation of CO2 in Homogeneous Media, CRC Press, 1999, pp. 391-410.
Halmann and Steinberg, Greenhouse gas carbon dioxide mitigation: science and technology—Chapter 12: Electrochemical Reduction of CO2, CRC Press, 1999, pp. 411-515.
Halmann and Steinberg, Greenhouse gas carbon dioxide mitigation: science and technology—Chapter 13: Photoelectrochemical Reduction of CO2, CRC Press, 1999, pp. 517-527.
Colin Oloman and Hui Li, Electrochemical Processing of Carbon Dioxide, ChemSusChem 2008, 1, 385-391, Copyright 2008 Wiley-VCH Verlag GmbH& Co. KGaA, Weinheim, www.chemsuschem.org.
Hui Li and Colin Oloman, Development of a continuous reactor for the electro-reduction of carbon dioxide to formate—Part 1: Process variables, Journal of Applied Electrochemistry (2006) 36:1105-1115, Copyright Springer 2006.
Hui Li and Colin Oloman, Development of a continuous reactor for the electro-reduction of carbon dioxide to formate—Part 2: Scale-up, J Appl Electrochem (2007) 37:1107-1117.
Hui Li and Colin Oloman, The electro-reduction of carbon dioxide in a continuous reactor, Journal of Applied Electrochemistry (2005) 35:955-965, Copyright Springer 2005.
PCT International Search Report dated Dec. 13, 2011, PCT/US11/45515, 2 pages.
Andrew P. Doherty, Electrochemical reduction of butraldehyde in the presence of CO2, Electrochimica Acta 47 (2002) 2963-2967, Copyright 2002 Elsevier Science Ltd.
PCT International Search Report dated Dec. 15, 2011, PCT/US11/45521, 2 pages.
Fan et al., Semiconductor Electrodes. 27. The p- and n-GaAs—N, N?-Dimet h yl-4,4'-bipyridinium System. Enhancement of Hydrogen Evolution on p-GaAs and Stabilization of n-GaAs Electrodes, Journal of the American Chemical Society, vol. 102, Feb. 27, 1980, pp. 1488-1492.
PCT International Search Report dated Jun. 23, 2010, PCT/US10/22594, 2 pages.
Emily Barton Cole and Andrew B. Bocarsly, Carbon Dioxide as Chemical Feedstock, Chapter 11—Photochemical, Electrochemical, and Photoelectrochemical Reduction of Carbon Dioxide, Copyright 2010 Wiley-VCH Verlag GmbH & Co. KGaA, Weinheim, 26 pages.
Barton Cole, Lakkaraju, Rampulla, Morris, Abelev, and Bocarsly; Using a One-Electron Shuttle for the Multielectron Reduction of CO2 to Methanol: Kinetic, Mechanistic, and Structural Insights; Mar. 29, 2010, 13 pages.
Morris, McGibbon, and Bocarsly; Electrocatalytic Carbon Dioxide Activation: The Rate-Determining Step of Pyridinium-Catalyzed CO2 Reduction; ChemSusChem 2011, 4, 191-196, Copyright 2011 Wiley-VCH Verlag GmbH& Co. KGaA, Weinheim.
Emily Barton Cole, Pyridinium-Catalyzed Electrochemical and Photoelectrochemical Conversion of CO2 to Fuels: A Dissertation Presented to the Faculty of Princeton University in Candidacy for the Degree of Doctor of Philosophy, Nov. 2009, pp. 1-141.

Barton, Rampulla, and Bocarsly; Selective Solar-Driven Reduction of CO2 to Methanol Using a Catalyzed pGaP Based Photoelectrochemical Cell; Oct. 3, 2007, 3 pages.
Mostafa Hossain, Nagaoka, and Ogura; Palladium and cobalt complexes of substituted quinoline, bipyridine and phenanthroline as catalysts for electrochemical reduction of carbon dioxide; Electrochimica Acta, vol. 42, No. 16, pp. 2577-2585, 1997.
Keene, Creutz, and Sutin; Reduction of Carbon Dioxide by TRIS(2,2'-Bipyridine)Cobalt(I), Coordination Chemistry Reviews, 64 (1995) 247-260, Elsevier Science Publishers B.V., Amsterdam—Printed in The Netherlands.
Aurian-Blajeni, Halmann, and Manassen; Electrochemical Measurements on the Photoelectrochemical Reduction of Aqueous Carbon Dioxide on p-Gallium Phosphide and p-Gallium Arsenide Semiconductor Electrodes, Solar Energy Materials 8 (1983) 425-440, North-Holland Publishing Company.
Tan, Zou, and Hu; Photocatalytic reduction of carbon dioxide into gaseous hydrocarbon using TiO2 pellets; Catalysis Today 115 (2006) 269-273.
Bandi and Kuhne, Electrochemical Reduction of Carbon Dioxide in Water: Analysis of Reaction Mechanism on Ruthenium-Titanium-Oxide, J. Electrochem. Soc., vol. 139, No. 6, Jun. 1992 (C) The Electrochemical Society, Inc., pp. 1605-1610.
B. Beden, A. Bewick and C. Lamy, A Study by Electrochemically Modulated Infrared.Reflectance Spectroscopy of the Electrosorption of Formic Acid at a Platinum Electrode, J. Electroanal. Chem., 148 (1983) 147-160, Elsevier Sequoia S.A., Lausanne—Printed in The Netherlands.
Bell and Evans, Kinetics of the Dehydration of Methylene Glycol in Aqueous Solution, Proceedings of the Royal Society of London, Series A, Mathematical and Physical Sciences, vol. 291, No. 1426 (Apr. 26, 1966), pp. 297-323.
Bian, Sumi, Furue, Sato, Kolke, and Ishitani; A Novel Tripodal Ligand, Tris[(4'-methyl-2,2'-bipyridyl-4-yl)-methyl]carbinol and Its Trinuclear RuII/ReI Mixed-Metal Complexes: Synthesis, Emission Properties, and Photocatalytic CO2 Reduction; Inorganic Chemistry, vol. 47, No. 23, 2008, pp. 10801-10803.
T. Bundgaard, H. J. Jakobsen, and E. J. Rahkamaa; A High-Resolution Investigation of Proton Coupled and Decoupled 13C FT NMR Spectra of 15N-Pyrrole; Journal of Magnetic Resonance 19,345-356 (1975).
D. Canfield and K. W. Frese, Jr, Reduction of Carbon Dioxide to Methanol on n- and p-GaAs and p-InP. Effect of Crystal Face, Electrolyte and Current Density, Journal of the Electrochemical Society, vol. 130, No. 8, Aug. 1983, pp. 1772-1773.
Arakawa, et al., Catalysis Research of Relevance to Carbon Management: Progress, Challenges, and Opportunities, Chem. Rev. 2001, 101, 953-996.
Chang, Ho, and Weaver; Applications of real-time infrared spectroscopy to electrocatalysis at bimetallic surfaces, I. Electrooxidation of formic acid and methanol on bismuth-modified Pt(111) and Pt(100), Surface Science 265 (1992) 81-94.
S. Clarke and J. A. Harrison, The Reduction of Formaldehyde, Electroanalytical Chemistry and Interfacial Electrochemistry, J. Electroanal. Chem., 36 (1972), pp. 109-115, Elsevier Sequoia S.A., Lausanne Printed in The Netherlands.
Li, Markley, Mohan, Rodriguez-Santiago, Thompson, and Van Niekerk; Utilization of Carbon Dioxide From Coal-Fired Power Plant for the Production of Value-Added Products; Apr. 27, 2006, 109 pages.
Green et al., "Vapor-Liquid Equilibria of Formaldehyde-Methanol-Water", Industrial and Engineering Chemistry (Jan. 1955), vol. 47, No. 1, pp. 103-109.
Shibata et al., "Electrochemical Synthesis of Urea at Gas-Diffusion Electrodes Part VI. Simultaneous Reduction of Carbon Dioxide and Nitrite Ions with Various Metallophthalocyanine Catalysts". J. of Electroanalytical Chemistry (no month, 2001), vol. 507, pp. 177-184.
Jaaskelainen and Haukka, The Use of Carbon Dioxide in Ruthenium Carbonyl Catalyzed 1-hexene Hydroformylation Promoted by Alkali Metal and Alkaline Earth Salts, Applied Catalysis A: General, 247, 95-100 (2003).
Heldebrant et al., "Reversible Zwitterionic Liquids, The Reaction of Alkanol Guanidines, Alkanol Amidines, and Diamines wih CO2", Green Chem. (mo month, 2010), vol. 12, pp. 713-721.
Perez et al., "Activation of Carbon Dioxide by Bicyclic Amidines", J. Org. Chem. (no month, 2004), vol. 69, pp. 8005-8011.

* cited by examiner

| Cathode / Catalyst | Electrolyte | Cathode Potential | Urea (%) | Acetone (%) |
|---|---|---|---|---|
| SS 316 / 30mM imidazole | KCl, KNO2 | -1.4 V | 100 | 0 |
| Copper / No catalyst | NaHCO2, KNO2 | -1 V | 0 | 0 |
| Copper / 30mM imidazole | NaHCO2, KNO2 | -1 V | 1 | 99 |

FIG. 2

ELECTROCHEMICAL PRODUCTION OF UREA FROM NOX AND CARBON DIOXIDE

CROSS-REFERENCE TO RELATED APPLICATIONS

The present application claims the benefit under 35 U.S.C. §120 of the following applications:

U.S. patent application Ser. No. 12/846,221, entitled REDUCING CARBON DIOXIDE TO PRODUCTS, naming Emily Cole, Narayanappa Sivasankar, Andrew Bocarsly, Kyle Teamey, and Nety Krishna as inventors, now pending, filed Jul. 29, 2010.

U.S. patent application Ser. No. 12/845,995, entitled PURIFICATION OF CARBON DIOXIDE FROM A MIXTURE OF GASES, naming Kyle Teamey, Emily Cole, Narayanappa Sivasankar, and Andrew Bocarsly as inventors, now pending, filed Jul. 29, 2010.

U.S. patent application Ser. No. 12/846,011, entitled HETEROCYCLE CATALYZED ELECTROCHEMICAL PROCESS, naming Emily Cole and Andrew Bocarsly as inventors, now pending, filed Jul. 29, 2010.

U.S. patent application Ser. No. 12/846,002, entitled ELECTROCHEMICAL PRODUCTION OF SYNTHESIS GAS FROM CARBON DIOXIDE, naming Narayanappa Sivasankar, Emily Cole, and Kyle Teamey as inventors, now pending, filed Jul. 29, 2010.

Each of the above-listed applications is hereby incorporated by reference in their entireties.

FIELD

The present disclosure generally relates to the field of chemical reduction, and more particularly to a method and/or apparatus for implementing electrochemical production of urea from NOx and carbon dioxide.

BACKGROUND

The combustion of fossil fuels in activities such as electricity generation, transportation, and manufacturing produces billions of tons of carbon dioxide annually. Research since the 1970s indicates increasing concentrations of carbon dioxide in the atmosphere may be responsible for altering the Earth's climate, changing the pH of the ocean and other potentially damaging effects. Countries around the world, including the United States, are seeking ways to mitigate emissions of carbon dioxide.

A mechanism for mitigating emissions is to convert carbon dioxide into economically valuable materials such as fuels and industrial chemicals. If the carbon dioxide is converted using energy from renewable sources, both mitigation of carbon dioxide emissions and conversion of renewable energy into a chemical form that can be stored for later use will be possible. Urea is an important fertilizer and industrial chemical used around the world. Industrially, urea is synthesized from carbon dioxide and ammonia at temperatures between 150 to 210 degrees Celsius and pressures of 120 to 400 atmospheres. Ammonia is typically produced from hydrogen and nitrogen at relatively high temperatures and pressures. The overall process of industrially synthesizing urea requires a large amount of energy, which generally comes from natural gas. The combustion of natural gas contributes to the concentration of carbon dioxide in the atmosphere and thus, global climate change.

Previous work in the field of electrochemical techniques has many limitations, including the stability of systems used in the process, the efficiency of systems, the selectivity of the systems or processes for a desired chemical, the cost of materials used in systems/processes, the ability to control the processes effectively, and the rate at which carbon dioxide is converted. In particular, existing electrochemical and photochemical processes/systems have one or more of the following problems that prevent commercialization on a large scale. Several processes utilize metals such as ruthenium or gold that are rare and expensive. In other processes, organic solvents were used that made scaling the process difficult because of the costs and availability of the solvents, such as dimethyl sulfoxide, acetonitrile and propylene carbonate. Copper, silver and gold have been found to reduce carbon dioxide to various products, however, the electrodes are quickly "poisoned" by undesirable reactions on the electrode and often cease to work in less than an hour. Similarly, gallium-based semiconductors reduce carbon dioxide, but rapidly dissolve in water. Many cathodes produce a mixture of organic products. For instance, copper produces a mixture of gases and liquids including carbon monoxide, methane, formic acid, ethylene, and ethanol. Such mixtures of products make extraction and purification of the products costly and can result in undesirable waste products that must be disposed. Much of the work done to date on carbon dioxide reduction is inefficient because of high electrical potentials utilized, low faradaic yields of desired products, and/or high pressure operation. The energy consumed for reducing carbon dioxide thus becomes prohibitive. Many conventional carbon dioxide reduction techniques have very low rates of reaction. For example, in order to provide economic feasibility, a commercial system currently may require densities in excess of 100 milliamperes per centimeter squared (mA/cm2), while rates achieved in the laboratory are orders of magnitude less.

SUMMARY

A method for electrochemical production of urea may include, but is not limited to, steps (A) to (B). Step (A) may introduce carbon dioxide and NOx to a solution of an electrolyte and a heterocyclic catalyst in an electrochemical cell. The electrochemical cell may include an anode in a first cell compartment and a cathode in a second cell compartment. The cathode may reduce the carbon dioxide to a first sub-product and the NOx to a second sub-product. Step (B) may combine the first sub-product and the second sub-product to produce urea.

A method for electrochemical production of urea may include, but is not limited to, steps (A)-(C). Step (A) may introduce carbon dioxide and NOx to a solution of an electrolyte and a heterocyclic catalyst in an electrochemical cell. The electrochemical cell may include an anode in a first cell compartment and a cathode in a second cell compartment. The cathode may reduce the carbon dioxide to a first sub-product and the NOx to a second sub-product. Step (B) may combine the first sub-product and the second sub-product to produce urea. Step (C) may vary a yield of urea by adjusting at least one of (a) a cathode material, (b) the heterocyclic catalyst type, (c) an electrical potential of the cathode, and (d) the electrolyte type.

A system for electrochemical production of urea may include, but is not limited to, an electrochemical cell, a carbon dioxide source, a NOx source, and an energy source. The electrochemical cell may include a first cell compartment, an anode positioned within the first cell compartment, a second cell compartment, a separator interposed between the first cell compartment and the second cell compartment, and a cathode and a heterocyclic catalyst positioned within the second cell compartment. The first cell compartment and the second cell compartment may each contain an electrolyte. The carbon dioxide source may be coupled with the second cell compartment and be configured to supply carbon dioxide to the cathode. The NOx source may be coupled with the second cell compartment and be configured to supply NOx to the cathode. The fluid source may be coupled with the first cell compartment. The energy source may be operably coupled with the anode and the cathode and be configured to provide power to the anode and the cathode, to reduce carbon dioxide at the cathode to a first sub-product, to reduce NOx at the cathode to a second sub-product, and to oxidize the fluid at the anode. The first sub-product and the second sub-product may be configured to combine to form urea.

It is to be understood that both the foregoing general description and the following detailed description are exemplary and explanatory only and are not necessarily restrictive of the disclosure as claimed. The accompanying drawings, which are incorporated in and constitute a part of the specification, illustrate an embodiment of the disclosure and together with the general description, serve to explain the principles of the disclosure.

BRIEF DESCRIPTION OF THE DRAWINGS

The numerous advantages of the present disclosure may be better understood by those skilled in the art by reference to the accompanying figures in which:

FIG. 2 is a table illustrating relative product yields for different cathode materials, catalysts, and electrolyte combinations;

DETAILED DESCRIPTION

Figure 1:
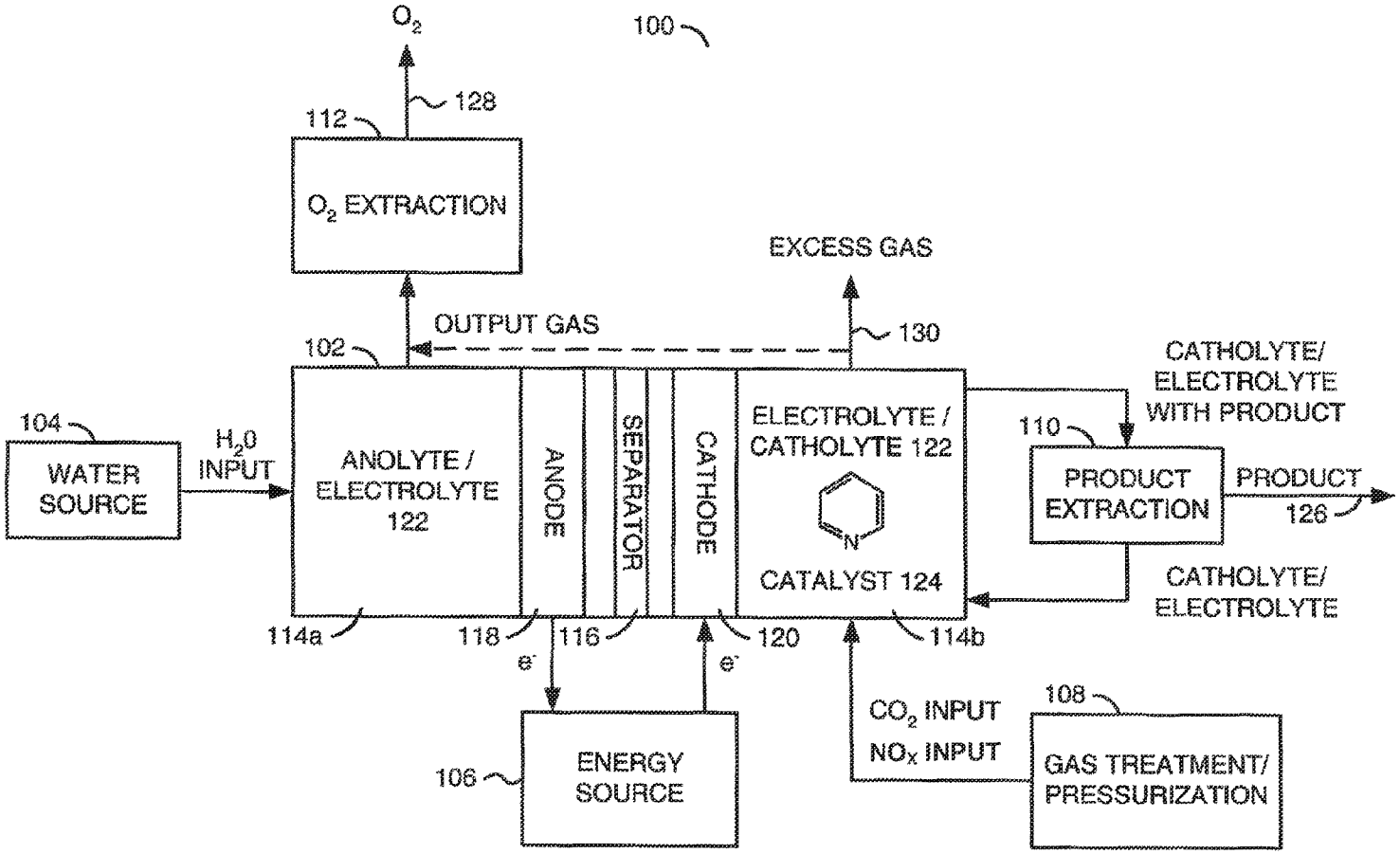
FIG. 1 is a block diagram of a system in accordance with an embodiment of the present disclosure.

Reference will now be made in detail to the presently preferred embodiments of the present disclosure, examples of which are illustrated in the accompanying drawings.

In accordance with some embodiments of the present invention, an electrochemical system is provided that generally allows carbon dioxide and NOx to be converted to urea. In some embodiments, the energy used by the system may be generated from an alternative energy source to avoid generation of additional carbon dioxide through combustion of fossil fuels.

The reduction of carbon dioxide may be suitably catalyzed by heterocyclic catalysts which may include nitrogen, sulfur, and oxygen-containing heterocycles and substituted heterocycles (e.g., pyridine, imidazole and substituted derivatives). The system may include electrolytes consisting of water as a solvent and suitable salts that are water soluble.

Some embodiments of the present invention thus relate to environmentally beneficial methods for reducing carbon dioxide. The methods generally include electrochemically and/or photoelectrochemically reducing the carbon dioxide in an aqueous, electrolyte-supported divided electrochemical cell that includes an anode in a cell compartment and a cathode in another cell compartment. A catalyst may be included to produce a reduced product. Carbon dioxide may be continuously bubbled through the cathode electrolyte solution to saturate the solution.

For electrochemical reductions, the electrode may be a suitable conductive electrode, such as Al, Au, Ag, C, Cd, Co, Cr, Cu, Cu alloys (e.g., brass and bronze), Ga, Hg, In, Mo, Nb, Ni, Ni alloys, Ni—Fe alloys, Sn, Sn alloys, Ti, V, W, Zn, stainless steel (SS), austenitic steel, ferritic steel, duplex steel, martensitic steel, Nichrome, elgiloy (e.g., Co—Ni—Cr), degenerately doped p-Si, degenerately doped p-Si:As and degenerately doped p-Si:B. Other conductive electrodes may be implemented to meet the criteria of a particular application. For photoelectrochemical reductions, the electrode may be a p-type semiconductor, such as p-GaAs, p-GaP, p-InN, p-InP, p-CdTe, p-$GaInP_2$ and p-Si. Other semiconductor electrodes may be implemented to meet the criteria of a particular application.

Control of the electrochemical process may enable production of a desired product by controlling combinations of metal cathodes, catalysts, and electrolytes. Efficiency of the process may be selectively increased by employing a catalyst/cathode combination selective for reduction of carbon dioxide to a first sub-product (e.g., carbon monoxide or other reduced $CO_2$ species such as surface bound —HCOO and —HCO moieties) in conjunction with cathode materials selective for reducing NOx to a second sub-product (e.g., ammonia or an ammonia-like compound (i.e., an intermediate product resulting from the reduction of NOx such as surface bound —NHO species)). For catalytic reduction of carbon dioxide, the cathode materials may include Sn, Ag, Cu, steel, and alloys of Cu and Ni. For catalytic reduction of NOx, the cathode materials may include Ni, Pt, and Au.

The catalyst for conversion of carbon dioxide and NOx electrochemically or photoelectrochemically may be nitrogen, sulfur, and oxygen-containing heterocycles which may include pyridine, imidazole, pyrrole, thiazole, furan, and thiophene. The catalyst may also include substituted heterocycles, such as amino-thiazole and benzimidazole. A heterocyclic amine catalyst may be utilized which may include, but is not limited to, heterocyclic compounds that are 5-member or 6-member rings with at least one ring nitrogen. For example, pyridines, imidazoles and related species with at least one five-member ring, bipyridines (e.g., two connected pyridines) and substituted derivatives were generally found suitable as catalysts for the electrochemical reduction and/or the photoelectrochemical reduction. Amines that have sulfur or oxygen in the rings may also be suitable for the reductions. Amines with sulfur or oxygen may include thiazoles or oxazoles. Other aromatic amines (e.g., quinolines, adenine, azoles, indoles, benzimidazole and 1,10-phenanthroline) may also be effective electrocatalysts.

Carbon dioxide may be photochemically or electrochemically reduced to carbon monoxide or other reduced $CO_2$ intermediates, and NOx may be photochemically or electrochemically reduced to ammonia or an ammonia-like intermediate compound. The carbon monoxide and the ammonia or ammonia-like compound may combine to form urea as a product of the system. Current reduction processes are generally highly energy-consuming and thus are not efficient ways for a high yield, economical conversion of carbon dioxide and NOx to urea.

On the other hand, the use of processes for converting carbon dioxide and NOx to urea in accordance with some embodiments of the invention generally has the potential to lead to a significant reduction of carbon dioxide, a major greenhouse gas, in the atmosphere and thus to the mitigation of global warming.

Before any embodiments of the invention are explained in detail, it is to be understood that the embodiments may not be limited in application per the details of the structure or the function as set forth in the following descriptions or illustrated in the figures of the drawing. Different embodiments may be capable of being practiced or carried out in various ways. Also, it is to be understood that the phraseology and terminology used herein is for the purpose of description and should not be regarded as limiting. The use of terms such as "including," "comprising," or "having" and variations thereof herein are generally meant to encompass the item listed thereafter and equivalents thereof as well as additional items. Further, unless otherwise noted, technical terms may be used according to conventional usage.

In the following description of methods, process steps may be carried out over a range of temperatures (e.g., approximately 1° C. (Celsius) to 70° C.) and a range of pressures (e.g., approximately 1 to 10 atmospheres) unless otherwise specified. Numerical ranges recited herein generally include all values from the lower value to the upper value (e.g., all possible combinations of numerical values between the lowest value and the highest value enumerated are considered expressly stated). For example, if a concentration range or beneficial effect range is stated as 1% to 50%, it is intended that values such as 2% to 40%, 10% to 30%, or 1% to 3%, etc., are expressly enumerated. The above may be simple examples of what is specifically intended.

A use of electrochemical or photoelectrochemical reduction of carbon dioxide and NOx, tailored with certain electrocatalysts, may produce urea in a high yield of approximately 80% to 100% as a relative percentage of carbon-containing products, based on the amount of carbon dioxide. The yield may suitably be about 90% to 100%, and more suitably about 95% to 100%. With an electric potential of −0.5 to −1.4 volts (V) with respect to a saturated calomel electrode (SCE), urea may be produced with good faradaic efficiency at the cathode.

The reduction of the carbon dioxide and NOx may be suitably achieved efficiently in a divided electrochemical or photoelectrochemical cell in which (i) a compartment contains an anode suitable to oxidize or split the water, and (ii) another compartment contains a working cathode electrode and a catalyst. The compartments may be separated by a porous glass frit, microporous separator, ion exchange membrane, or other ion conducting bridge. Both compartments generally contain an aqueous solution of an electrolyte. Carbon dioxide gas may be continuously bubbled through the cathodic electrolyte solution to saturate the solution.

In the working electrode compartment, carbon dioxide may be continuously bubbled through the solution. In some embodiments, if the working electrode is a conductor, an external bias may be impressed across the cell such that the potential of the working electrode is held constant. In other embodiments, if the working electrode is a p-type semiconductor, the electrode may be suitably illuminated with light. An energy of the light may be matching or greater than a bandgap of the semiconductor during the electrolysis. Furthermore, either no external source of electrical energy may be used or a modest bias (e.g., about 500 millivolts) may be applied. The working electrode potential is generally held constant relative to the SCE. The electrical energy for the electrochemical reduction of carbon dioxide may come from a normal energy source, including nuclear and alternatives (e.g., hydroelectric, wind, solar power, geothermal, etc.), from a solar cell, or other nonfossil fuel source of electricity, provided that the electrical source supply at least approximately 1.5 volts across the cell. Other voltage values may be adjusted depending on the internal resistance of the cell employed.

Advantageously, the carbon dioxide may be obtained from any source (e.g., an exhaust stream from fossil-fuel burning power or industrial plants, from geothermal or natural gas wells or the atmosphere itself). Most suitably, the carbon dioxide may be obtained from concentrated point sources of generation prior to being released into the atmosphere. For example, high concentration carbon dioxide sources may frequently accompany natural gas in amounts of 5% to 50%, exist in flue gases of fossil fuel (e.g., coal, natural gas, oil, etc.) burning power plants, and nearly pure carbon dioxide may be exhausted from cement factories and from fermenters used for industrial fermentation of ethanol. Certain geothermal steams may also contain significant amounts of carbon dioxide. The carbon dioxide emissions from varied industries, including geothermal wells, may be captured on-site. Separation of the carbon dioxide from such exhausts is known. Thus, the capture and use of existing atmospheric carbon dioxide in accordance with some embodiments of the present invention generally allow the carbon dioxide to be a renewable and unlimited source of carbon.

The electrochemical/photoelectrochemical reduction of the carbon dioxide generally utilizes one or more catalysts in the aqueous solution. Aromatic heterocyclic amines may include, but are not limited to, unsubstituted and substituted pyridines and imidazoles. Substituted pyridines and imidazoles may include, but are not limited to mono and disubstituted pyridines and imidazoles. For example, suitable catalysts may include straight chain or branched chain lower alkyl (e.g., C1-C10) mono and disubstituted such as 2-methylpyridine, 4-tertbutyl pyridine, 2,6-dimethylpyridine (2,6-lutidine); bipyridines, such as 4,4'-bipyridine; amino-substituted pyridines, such as 4-dimethylamino pyridine; and hydroxyl-substituted pyridines (e.g., 4-hydroxy-pyridine) and substituted or unsubstituted quinoline or isoquinolines. The catalysts may also suitably include substituted or unsubstituted dinitrogen heterocyclic amines, such as pyrazine, pyridazine and pyrimidine. Other catalysts generally include azoles, imidazoles, indoles, oxazoles, thiazoles, substituted species and complex multi-ring amines such as adenine, pterin, pteridine, benzimidazole, phenonthroline and the like.

Referring to FIG. 1, a block diagram of a system 100 is shown in accordance with a specific embodiment of the present invention. The system (or apparatus) 100 generally comprises a cell (or container) 102, a liquid source 104, a power source 106, a gas source 108, an extractor 110 and an extractor 112. A product may be presented from the extractor 110. An output gas may be presented from the extractor 112. Another output gas may be presented from the cell 102.

The cell 102 may be implemented as a divided cell. The divided cell may be a divided electrochemical cell and/or a divided photochemical cell. The cell 102 is generally operational to reduce carbon dioxide ($CO_2$) and nitrogen oxides (NOx, which may be nitrites and/or nitrates) into urea. The reduction generally takes place by bubbling carbon dioxide and NOx into an aqueous solution of an electrolyte in the cell 102. A cathode 120 in the cell 102 may reduce the carbon dioxide and the NOx into one or more compounds. The one or more compounds formed from the reduction of the carbon dioxide and the NOx may combine to form urea as a product.

The cell 102 generally comprises two or more compartments (or chambers) **114*a*-114*b*, a separator (or membrane) 116, an anode 118, and a cathode 120. The anode 118 may be disposed in a given compartment (e.g., 114***a*). The cathode 120 may be disposed in another compartment (e.g., 114*b*) on an opposite side of the separator 116 as the anode 118. An aqueous solution 122 may fill both compartments 114*a*-114*b*. The aqueous solution 122 may include water as a solvent and water soluble salts (e.g., potassium chloride (KCl) and potassium nitrite (KNO2)). A catalyst 124 may be added to the compartment 114*b* containing the cathode 120.

The liquid source 104 may implement a water source. The liquid source 104 may be operational to provide pure water to the cell 102.

The power source 106 may implement a variable voltage source. The power source 106 may be operational to generate an electrical potential between the anode 118 and the cathode 120. The electrical potential may be a DC voltage.

The gas source 108 may implement a carbon dioxide source and a NOx source. The source 108 is generally operational to provide carbon dioxide and NOx to the cell 102. In some embodiments, the carbon dioxide and/or the NOx is bubbled directly into the compartment 114*b* containing the cathode 120.

The extractor 110 may implement an organic product and/or inorganic product extractor. The extractor 110 is generally operational to extract (separate) products (e.g., urea) from the electrolyte 122. The extracted products may be presented through a port 126 of the system 100 for subsequent storage and/or consumption by other devices and/or processes.

The extractor 112 may implement an oxygen extractor. The extractor 112 is generally operational to extract oxygen (e.g., $O_2$) byproducts created by the reduction of the carbon dioxide and/or the oxidation of water. The extracted oxygen may be presented through a port 128 of the system 100 for subsequent storage and/or consumption by other devices and/or processes. Chlorine and/or oxidatively evolved chemicals may also be byproducts in some configurations, such as in an embodiment of processes other than oxygen evolution occurring at the anode 118. Such processes may include chlorine evolution, oxidation of organics, and corrosion of a sacrificial anode. Any other excess gases (e.g., hydrogen) created by the reduction of the carbon dioxide and water may be vented from the cell 102 via a port 130.

In the process described, water may be oxidized (or split) to protons and oxygen at the anode 118 while the carbon dioxide is reduced to carbon monoxide or a $CO_2$-derived intermediate species at the cathode 120 and the NOx is reduced to ammonia or an ammonia-like intermediate compound at the cathode 120. The electrolyte 122 in the cell 102 may use water as a solvent with any salts that are water soluble and with a pyridine or pyridine-derived catalyst 124. The catalysts 124 may include, but are not limited to, nitrogen, sulfur and oxygen containing heterocycles. Examples of the heterocyclic compounds may be pyridine, imidazole, pyrrole, thiazole, furan, thiophene and the substituted heterocycles such as amino-thiazole and benzimidazole. Cathode materials generally include any conductor. However, efficiency of the process may be selectively increased by employing a catalyst/cathode combination selective for reduction of carbon dioxide to carbon monoxide or a reduced $CO_2$ intermediate species in conjunction with cathode materials selective for reducing NOx to ammonia or an ammonia-like intermediate compound. For catalytic reduction of carbon dioxide, the cathode materials may include Sn, Ag, Cu, steel, and alloys of Cu and Ni. For catalytic reduction of NOx, the cathode materials may include Ni, Pt, and Au. The materials may be in bulk form. Additionally and/or alternatively, the materials may be present as particles or nanoparticles loaded onto a substrate, such as graphite, carbon fiber, or other conductor.

An anode material sufficient to oxidize or split water may be used. The overall process may be generally driven by the power source 106. Combinations of cathodes 120, electrolytes 122, and catalysts 124 may be used to control the reaction products of the cell 102.

Experiments were conducted in one, two, and three-compartment electrochemical cells 102 with an SCE as the reference electrode. A platinum anode or mixed metal oxide anodes were utilized. The experiments were generally conducted at ambient temperature and pressure. Carbon dioxide was bubbled into the cells during the experiments. NOx was introduced to the electrolyte of the cell. A potentiostat or DC power source 106 provided the electrical energy to drive the process. Cell potentials ranged from 2 volts to 4 volts, depending on the cathode material. Half cell potentials at the cathode ranged from −0.5 volts to −1.45 volts relative to the SCE, depending on the cathode material used. Products from the experiments were analyzed using gas chromatography, nuclear magnetic resonance spectroscopy, and a quadrupole mass spectrometer.

Referring to FIG. 2, a table illustrating relative product yields for varying cathode material, catalyst, electrolyte, and cathode potential combinations are shown. The combinations listed in the tables generally are not the only combinations providing a given product. The combinations illustrated demonstrate yields of the products as relative percentages of carbon-containing products observed. As shown in FIG. 2, a stainless steel cathode (SS 316) with a 30 mM imidazole catalyst with a cathode potential of −1.4 (versus SCE) yielded 100% urea (relative to organic products). In the instance where no catalyst was used, with copper as the cathode material, no urea or acetone was produced, thus demonstrating the importance of the catalyst in producing urea. In the instance where an imidazole catalyst was used with copper as the cathode material, 1% urea was produced, with the balance 99% as acetone.

Faradaic yields for the products may be improved by controlling the electrical potential of the reaction. By maintaining a constant potential at the cathode 120, hydrogen evolution is generally reduced and faradaic yields of the products increased. Addition of hydrogen inhibitors such as acetonitrile, certain heterocycles, alcohols, and other chemicals may also increase yields of the products.

With some embodiments, stability may be improved with cathode materials known to poison rapidly when reducing carbon dioxide. Copper and copper-alloy electrodes commonly poison in less than an hour of electrochemically reducing carbon dioxide. However, when used with a heterocyclic amine catalyst, copper-based alloys were operated for many hours without any observed degradation in effectiveness. The effects were particularly enhanced by using sulfur containing heterocycles. For instance, a system with a copper cathode and 2-amino thiazole catalyst showed very high stability for the reduction of carbon dioxide.

Heterocycles other than pyridine may catalytically reduce carbon dioxide in the electrochemical process using many aforementioned cathode materials, including tin, steels, nickel alloys and copper alloys. Nitrogen-containing heterocyclic amines shown to be effective include azoles, indoles, 4,4'-bipyridines, picolines (methyl pyridines), lutidines (dimethyl pyridines), hydroxy pyridines, imidazole, benzimidazole, methyl imidazole, pyrazine, pyrimidine, pyridazine, pyridazineimidazole, nicotinic acid, quinoline, adenine and 1,10-phenanthroline. Sulfur containing heterocycles include thiazole, aminothiazoles, thiophene. Oxygen containing heterocycles include furan and oxazole. As with pyridine, the combination of catalyst, cathode material and electrolyte may be used to control product mix.

Figure 3:
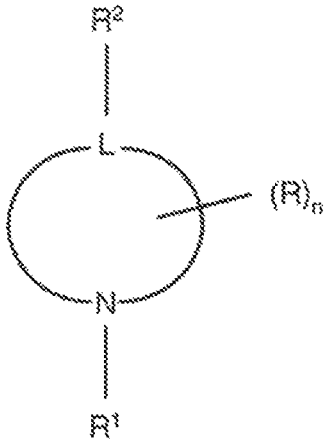
FIG. 3 is a formula of an aromatic heterocyclic amine catalyst.

Referring to FIG. 3, a formula of an aromatic heterocyclic amine catalyst is shown. The ring structure may be an aromatic 5-member heterocyclic ring or 6-member heterocyclic ring with at least one ring nitrogen and is optionally substituted at one or more ring positions other than nitrogen with R. L may be C or N. R1 may be H. R2 may be H if L is N or R2 is R if L is C. R is an optional substituent on any ring carbon and may be independently selected from H, a straight chain or branched chain lower alkyl, hydroxyl, amino, pyridyl, or two R's taken together with the ring carbons bonded thereto are a fused six-member aryl ring and n=0 to 4.

Figure 4:
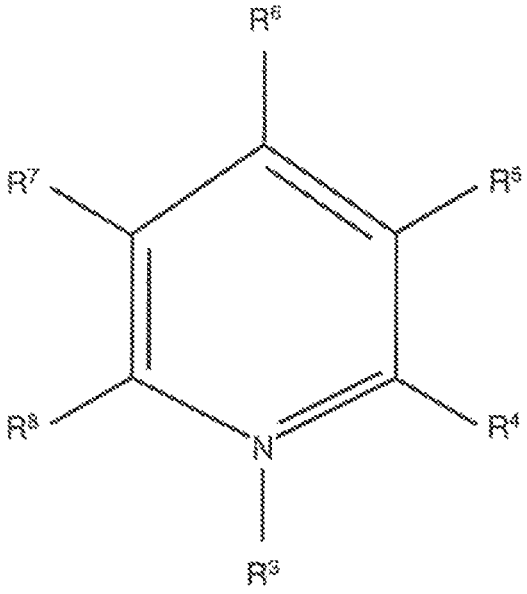
FIGS. 4-6 are formulae of substituted or unsubstituted aromatic 5-member heterocyclic amines or 6-member heterocyclic amines.
Figure 5:
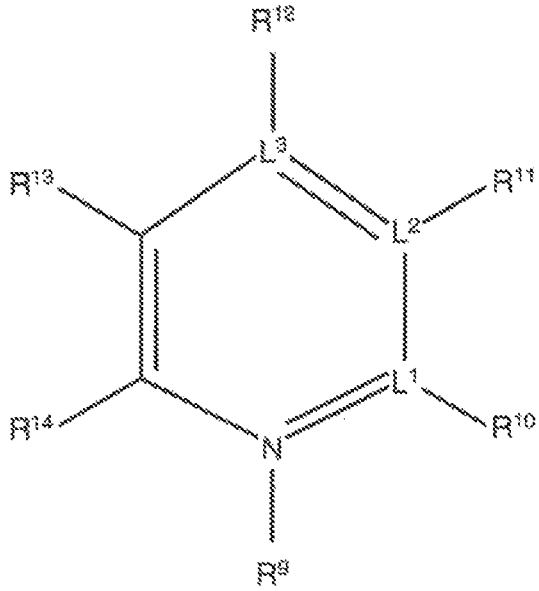
Figure 6:
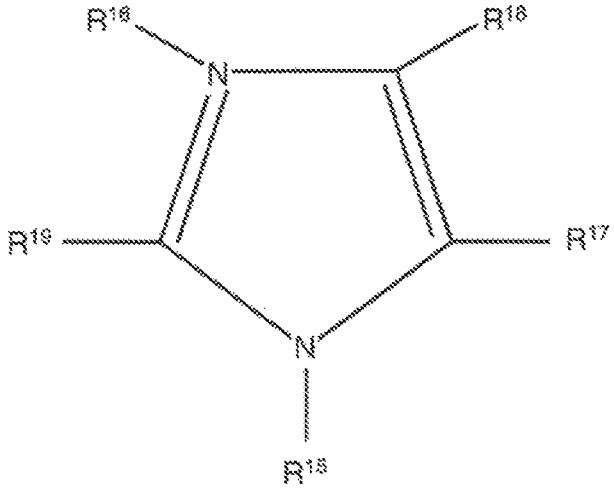

Referring to FIGS. 4-6, formulae of substituted or unsubstituted aromatic 5-member heterocyclic amines or 6-member heterocyclic amines are shown. Referring to FIG. 4, R3 may be H. R4, R5, R7 and R8 are generally independently H, straight chain or branched chain lower alkyl, hydroxyl, amino, or taken together are a fused six-member aryl ring. R6 may be H, straight chain or branched chain lower alkyl, hydroxyl, amino or pyridyl.

Referring to FIG. 5, one of L1, L2 and L3 may be N, while the other L's may be C. R9 may be H. If L1 is N, R10 may be H. If L2 is N, R11 may be H. If L3 is N, R12 may be H. If L1, L2 or L3 is C, then R10, R11, R12, R13 and R14 may be independently selected from straight chain or branched chain lower alkyl, hydroxyl, amino, or pyridyl.

Referring to FIGS. 6, R15 and R16 may be H. R17, R18 and R19 are generally independently selected from straight chain or branched chain lower alkyl, hydroxyl, amino, or pyridyl.

Suitably, the concentration of aromatic heterocyclic amine catalysts is about 1 millimolar (mM) to 1 M. The electrolyte may be suitably a salt, such as KCl, $NaNO_3$, $Na_2SO_4$, NaCl, NaF, $NaClO_4$, $KClO_4$, $K_2SiO_3$, or $CaCl_2$ at a concentration of about 0.5 M. Other electrolytes may include, but are not limited to, all group 1 cations (e.g., H, Li, Na, K, Rb and Cs) except Francium (Fr), Ca, ammonium cations, alkylammonium cations and alkyl amines. Additional electrolytes may include, but are not limited to, all group 17 anions (e.g., F, Cl, Br, I and At), borates, carbonates, nitrates, nitrites, perchlorates, phosphates, polyphosphates, silicates and sulfates. Na generally performs as well as K with regard to best practices, so NaCl may be exchanged with KCl. NaF may perform about as well as NaCl, so NaF may be exchanged for NaCl or KCl in many cases. The pH of the solution is generally maintained at about pH 3 to 8, suitably about 4.7 to 5.6.

Some embodiments of the present invention may be further explained by the following examples, which should not be construed by way of limiting the scope of the invention.

EXAMPLE 1

General Electrochemical Methods

Chemicals and materials. All chemicals used were >98% purity and used as received from the vendor (e.g., Aldrich), without further purification. Either deionized or high purity water (Nanopure, Barnstead) was used to prepare the aqueous electrolyte solutions.

Electrochemical system. The electrochemical system was composed of a standard two-compartment electrolysis cell 102 to separate the anode 118 and cathode 120 reactions. The compartments were separated by a porous glass frit or other ion conducting bridge 116. The electrolytes 122 were used at concentrations of 0.1 M to 1 M, with 0.5 M being a typical concentration. A concentration of between about 1 mM to 1 M of the catalysts 124 was used. The particular electrolyte 122 and particular catalyst 124 of each given test were generally selected based upon what product or products were being created.

Figure 7:
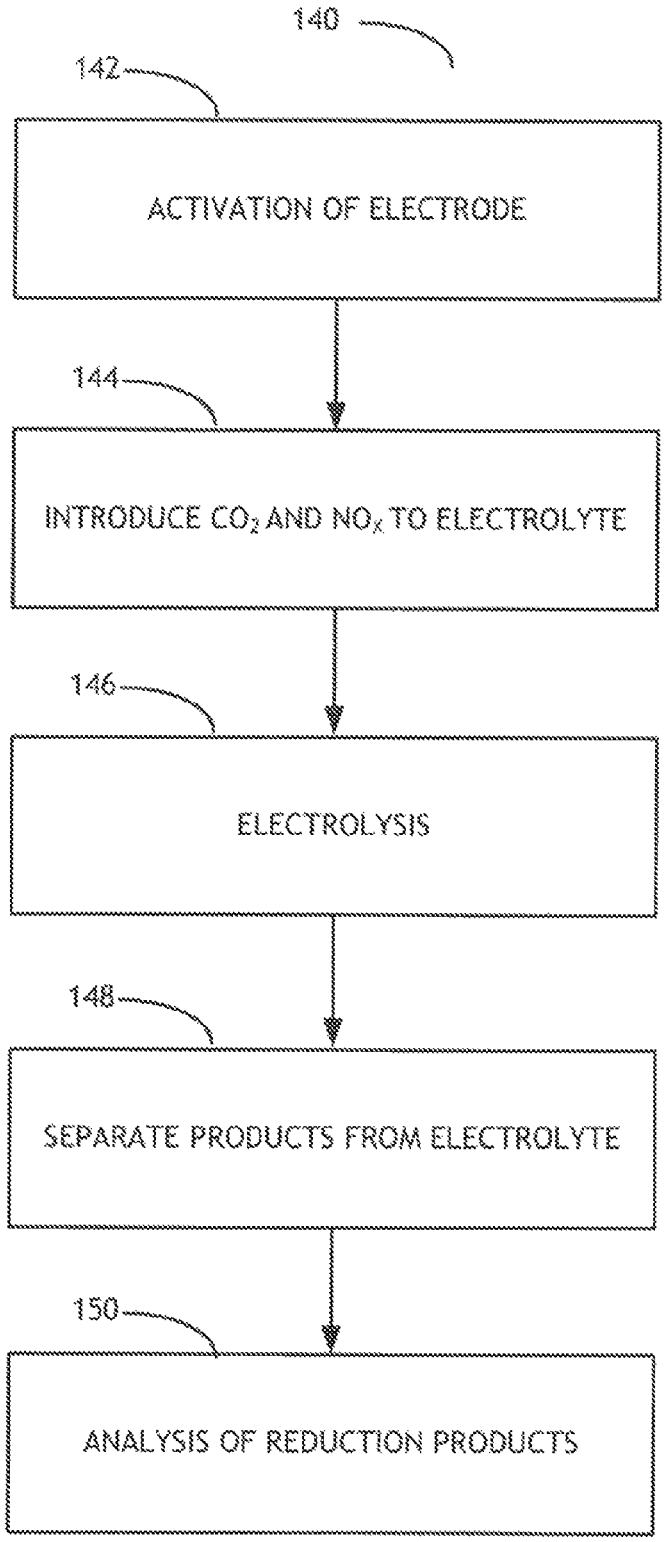
FIG. 7 is a flow diagram of an example method used in electrochemical examples.

Referring to FIG. 7, a flow diagram of an example method 140 used in the electrochemical examples is shown. The method (or process) 140 generally comprises a step (or block) 142, a step (or block) 144, a step (or block) 146, a step (or block) 148 and a step (or block) 150. The method 140 may be implemented using the system 100.

In the step 142, the electrodes 118 and 120 may be activated where appropriate. Introducing the carbon dioxide and the NOx into the cell 102 may be performed in the step 144. Electrolysis of the carbon dioxide and NOx into organic and/or inorganic products may occur during step 146. In the step 148, the products may be separated from the electrolyte. Analysis of the reduction products may be performed in the step 150.

The working electrode was of a known area. All potentials were measured with respect to a saturated calomel reference electrode (Accumet). Before and during all electrolysis, carbon dioxide (Airgas) was continuously bubbled through the electrolyte to saturate the solution. The resulting pH of the solution was maintained at about pH 3 to pH 8 with a suitable range depending on what product or products were being made. For example, under constant carbon dioxide bubbling, the pH levels of 10 mM solutions of 4-hydroxy pyridine, pyridine and 4-tertbutyl pyridine were 4.7, 5.28 and 5.55, respectively.

EXAMPLE 2

General Photoelectrochemical Methods

Chemicals and materials. All chemicals used were analytical grade or higher. Either deionized or high purity water (Nanopure, Barnstead) was used to prepare the aqueous electrolyte solutions.

Photoelectrochemical system. The photoelectrochemical system was composed of a Pyrex three-necked flask containing 0.5 M KCl as supporting electrolyte and a 1 mM to 1 M catalyst (e.g., 10 mM pyridine or pyridine derivative). The photocathode was a single crystal p-type semiconductor etched for approximately 1 to 2 minutes in a bath of concentrated HNO3:HCl, 2:1 v/v prior to use. An ohmic contact was made to the back of the freshly etched crystal using an indium/zinc (2 wt. % Zn) solder. The contact was connected to an external lead with conducting silver epoxy (Epoxy Technology H31) covered in glass tubing and insulated using an epoxy cement (Loctite 0151 Hysol) to expose only the front face of the semiconductor to solution. All potentials were referenced against a saturated calomel electrode (Accumet). The three electrode assembly was completed with a carbon rod counter electrode to minimize the reoxidation of reduced carbon dioxide products. During all electrolysis, carbon dioxide gas (Airgas) was continuously bubbled through the electrolyte to saturate the solution. The resulting pH of the solution was maintained at about pH 3 to 8 (e.g., pH 5.2).

Figure 8:
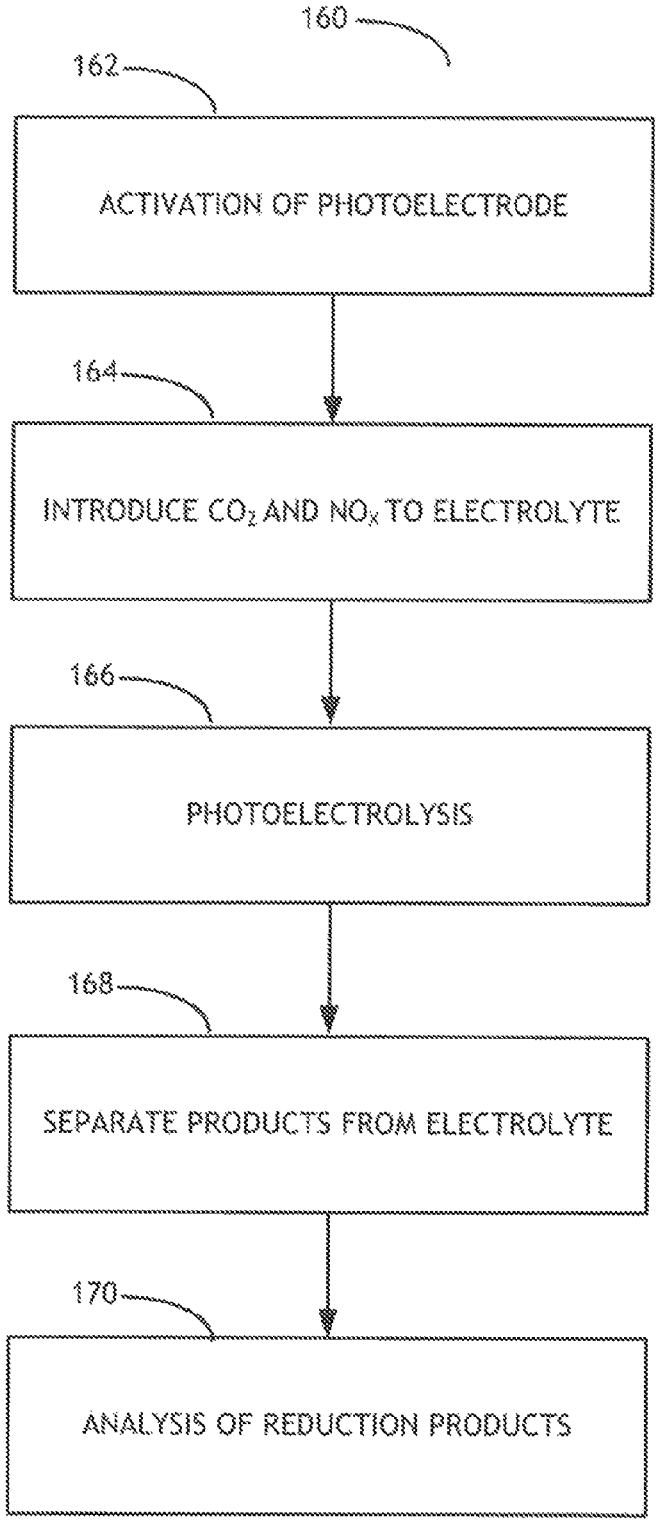
FIG. 8 is a flow diagram of an example method used in photochemical examples.

Referring to FIG. 8, a flow diagram of an example method 160 used in the photochemical examples is shown. The method (or process) 160 generally comprises a step (or block) 162, a step (or block) 164, a step (or block) 166, a step (or block) 168 and a step (or block) 170. The method 160 may be implemented using the system 100.

In the step 162, the photoelectrode may be activated. Introducing the carbon dioxide and the NOx into the cell 102 may be performed in the step 164. Electrolysis of the carbon dioxide and NOx into the products may occur during step 166. In the step 168, the products may be separated from the electrolyte. Analysis of the reduction products may be performed in the step 170.

Light sources. Four different light sources were used for the illumination of the p-type semiconductor electrode. For initial electrolysis experiments, a Hg—Xe arc lamp (USHIO UXM 200H) was used in a lamp housing (PTI Model A-1010) and powered by a PTI LTS-200 power supply. Similarly, a Xe arc lamp (USHIO UXL 151H) was used in the same housing in conjunction with a PTI monochromator to illuminate the electrode at various specific wavelengths.

A fiber optic spectrometer (Ocean Optics 52000) or a silicon photodetector (Newport 818-SL silicon detector) was used to measure the relative resulting power emitted through the monochromator. The flatband potential was obtained by measurements of the open circuit photovoltage during various irradiation intensities using the 200 watt (W) Hg—Xe lamp (3 W/cm2-23 W/cm2). The photovoltage was observed to saturate at intensities above approximately 6 W/cm2.

For quantum yield determinations, electrolysis was performed under illumination by two different light-emitting diodes (LEDs). A blue LED (Luxeon V Dental Blue, Future Electronics) with a luminous output of 500 milliwatt (mW)+/−50 mW at 465 nanometers (nm) and a 20 nm full width at half maximum (FWHM) was driven at to a maximum rated current of 700 mA using a Xitanium Driver (Advance Transformer Company). A Fraen collimating lens (Future Electronics) was used to direct the output light. The resultant power density that reached the window of the photoelectrochemical cell was determined to be 42 mW/cm2, measured using a Scientech 364 thermopile power meter and silicon photodetector. The measured power density was assumed to be greater than the actual power density observed at the semiconductor face due to luminous intensity loss through the solution layer between the wall of the photoelectrochemical cell and the electrode.

EXAMPLE 3

Analysis Of Products Of Electrolysis

Electrochemical experiments were generally performed using a CH Instruments potentiostat or a DC power supply with current logger to run bulk electrolysis experiments. The CH Instruments potentiostat was generally used for cyclic voltammetry. Electrolysis was run under potentiostatic conditions from approximately 1 hour to 30 hours until a relatively similar amount of charge was passed for each run.

Gas Chromatography. The electrolysis samples were analyzed using a gas chromatograph (HP 5890 GC) equipped with a FID detector. Removal of the supporting electrolyte salt was first achieved with an Amberlite IRN-150 ion exchange resin (cleaned prior to use to ensure no organic artifacts by stirring in a 0.1% v/v aqueous solution of Triton X-100, reduced (Aldrich), filtered and rinsed with a copious amount of water, and vacuum dried below the maximum temperature of the resin (approximately 60° C.) before the sample was directly injected into the GC which housed a DB-Wax column (Agilent Technologies, 60 m, 1 micrometer (pm) film thickness). Approximately 1 gram of resin was used to remove the salt from 1 milliliter (mL) of the sample. The injector temperature was held at 200° C., the oven temperature maintained at 120° C., and the detector temperature at 200° C.

Mass spectrometry. Mass spectral data was also collected to identify all organic compounds. In a typical experiment, the sample was directly leaked into a SRS Quadrupole Mass Spectrometer.

Nuclear Magnetic Resonance. NMR spectra of electrolyte volumes after bulk electrolysis were also obtained using an automated Bruker Ultrashield™ 500 Plus spectrometer with an excitation sculpting pulse technique for water suppression. Data processing was achieved using MestReNova software. The concentrations of urea and acetone present after bulk electrolysis were determined using acetonitrile or imidazole as the internal standards. NMR was the primary means of determining urea concentrations, showing a singlet peak at 5.6 ppm.

Carbon dioxide and NOx may be efficiently converted to value-added products, using either a minimum of electricity (that may be generated from an alternate energy source) or directly using visible light. Some processes described above may generate urea useful for chemical processes. Moreover, the catalysts for the processes may be substituents-sensitive and provide for selectivity of the value-added products.

By way of example, a fixed cathode (e.g., stainless steel 2205) may be used in an electrochemical system where the electrolyte and/or catalyst are altered to change the product mix. In a modular electrochemical system, the cathodes may be swapped out with different materials to change the product mix. In a hybrid photoelectrochemical system, the anode may use different photovoltaic materials to change the product mix.

Some embodiments of the present invention generally provide for new cathode materials, new electrolyte materials and new sulfur and oxygen-containing heterocyclic catalysts. Specific combinations of cathode materials, electrolytes, catalysts, and/or electrical potentials may be used to get a desired product. The organic products may include, but are not limited to, urea. Specific process conditions may be established that maximize the carbon dioxide and NOx conversion to specific chemicals beyond urea.

Cell parameters may be selected to minimize unproductive side reactions like H2 evolution from water electrolysis. Choice of specific configurations of heterocyclic amine pyridine catalysts with engineered functional groups may be utilized in the system 100 to achieve high faradaic yields. Process conditions described above may facilitate long life (e.g., improved stability), electrode and cell cycling and product recovery. Heterocyclic amines related to pyridine may be used to improve reaction rates, product yields, cell voltages and/or other aspects of the reaction. Heterocyclic catalysts that contain sulfur or oxygen may also be utilized in the carbon dioxide and NOx reduction.

Some embodiments of the present invention may provide cathode and electrolyte combinations for reducing carbon dioxide to products in commercial quantities. Catalytic reduction of carbon dioxide may be achieved using steel or other low cost cathodes. High faradaic yields (e.g., >20%) of organic products with steel and nickel alloy cathodes at ambient temperature and pressure may also be achieved. Copper-based alloys used at the electrodes may remain stable for long-term reduction of carbon dioxide. The relative low cost and abundance of the combinations described above generally opens the possibility of commercialization of electrochemical carbon dioxide reduction.

Various process conditions disclosed above, including cathode materials, electrolyte choice, catalyst choice, and cell voltage, generally improve control of the reaction so that different products or product mixtures may be made. Greater control over the reaction generally opens the possibility for commercial systems that are modular and adaptable to make different products. The new materials and process conditions combinations generally have high faradaic efficiency and relatively low cell potentials, which allows an energy efficient cell to be constructed.

It is believed that the present disclosure and many of its attendant advantages will be understood by the foregoing description, and it will be apparent that various changes may be made in the form, construction and arrangement of the components thereof without departing from the scope and spirit of the disclosure or without sacrificing all of its material advantages. The form herein before described being merely an explanatory embodiment thereof, it is the intention of the following claims to encompass and include such changes.

What is claimed is:

1. A method for electrochemical production of urea, comprising:

(A) introducing carbon dioxide and a nitrogen oxide to a solution of an electrolyte and a heterocyclic catalyst in an electrochemical cell, wherein (i) said electrochemical cell including an anode in a first cell compartment and a cathode in a second cell compartment, (ii) said cathode reducing said carbon dioxide into a first sub-product and reducing said nitrogen oxide into a second sub-product, and (iii) said heterocyclic catalyst includes at least one of adenine, a heterocyclic amine containing sulfur, a heterocyclic amine containing oxygen, an azole, benzimidazole, a bipyridine, furan, an imidazole, an imidazole related species with at least one five-member ring, an indole, methylimidazole, an oxazole, phenanthroline, pterin, pteridine, a pyridine, a pyridine related species with at least one six-member ring, pyrrole, quinoline, or a thiazole; and (B) combining said first sub-product and said second sub-product to produce urea.

2. The method of claim 1, wherein said nitrogen oxide includes at least one of nitrite or nitrate.

3. The method of claim 1, wherein said first sub-product is at least one of carbon monoxide or a reduced $CO_2$ intermediate species, and wherein said second sub-product is at least one of ammonia or an ammonia-related intermediate compound.

4. The method of claim 1, wherein said cathode includes at least one of Al, Au, Ag, C, Cd, Co, Cr, Cu, Cu alloys, Ga, Hg, In, Mo, Nb, Ni, Ni alloys, Ni—Fe alloys, Sn, Sn alloys, Ti, V, W, Zn, elgiloy, Nichrome, austenitic steel, duplex steel, ferritic steel, martensitic steel, stainless steel, degenerately doped p-Si, degenerately doped p-Si:As, or degenerately doped p-Si:B.

5. The method of claim 1, wherein said cathode includes a first cathode material for reducing said carbon dioxide and a second material for reducing said nitrogen oxide.

6. The method of claim 5, wherein said first cathode material includes at least one of tin, silver, copper, steel, or an alloy including at least one of copper or nickel.

7. The method of claim 5, wherein said second cathode material includes at least one of nickel, platinum, or gold.

8. A method for electrochemical production of urea, comprising:

(A) introducing carbon dioxide and a nitrogen oxide to a solution of an electrolyte and a heterocyclic catalyst in an electrochemical cell, wherein (i) said electrochemical cell including an anode in a first cell compartment and a cathode in a second cell compartment, (ii) said cathode reducing said carbon dioxide into a first sub-product and reducing said nitrogen oxide into a second sub-product, (iii) said heterocyclic catalyst includes at least one of adenine, a heterocyclic amine containing sulfur, a heterocyclic amine containing oxygen, an azole, benzimidazole, a bipyridine, furan, an imidazole, an imidazole related species with at least one five-member ring, an indole, methylimidazole, an oxazole, phenanthroline, pterin, pteridine, a pyridine, a pyridine related species with at least one six-member ring, pyrrole, quinoline, or a thiazole; and (B) combining said first sub-product and said second sub-product to produce urea; and (C) varying a yield of urea by adjusting at least one of (a) a material of said cathode, (b) said heterocyclic catalyst, (c) an electrical potential of said cathode, and (d) said electrolyte.

9. The method of claim 8, wherein said material of said cathode includes at least one of Al, Au, Ag, C, Cd, Co, Cr, Cu, Cu alloys, Ga, Hg, In, Mo, Nb, Ni, Ni alloys, Ni—Fe alloys, Sn, Sn alloys, Ti, V, W, Zn, elgiloy, Nichrome, austenitic steel, duplex steel, ferritic steel, martensitic steel, stainless steel, degenerately doped p-Si, degenerately doped p-Si:As, or degenerately doped p-Si:B.

10. The method of claim 8, wherein said electrical potential of said cathode ranges between approximately −0.5 volts to approximately −1.5 volts.

11. The method of claim 8, wherein said electrolyte includes at least one of $Na_2SO_4$, KCl, $NaNO_3$, NaCl, NaF, $NaClO_4$, $KClO_4$, $K_2SiO_3$, $CaCl_2$, a H cation, a Li cation, a Na cation, a K cation, a Rb cation, a Cs cation, a Ca cation, an ammonium cation, an alkylammonium cation, a F anion, a Cl anion, a Br anion, an I anion, an At anion, an alkyl amine, borates, carbonates, nitrites, nitrates, phosphates, polyphosphates, perchlorates, silicates, sulfates, or a tetraalkyl ammonium salt.

12. The method of claim 8, wherein combining said first sub-product and said second sub-product includes combining said first sub-product and said second sub-product in said electrochemical cell to produce urea.

13. The method of claim 8, wherein said cathode includes a first cathode material for reducing said carbon dioxide and a second material for reducing said nitrogen oxide.

14. The method of claim 13, wherein said first cathode material includes at least one of tin, silver, copper, steel, or an alloy including at least one of copper or nickel.

15. The method of claim 13, wherein said second cathode material includes at least one of nickel, platinum, or gold.

* * * * *